US008433563B2

(12) United States Patent
Vos et al.

(10) Patent No.: US 8,433,563 B2
(45) Date of Patent: Apr. 30, 2013

(54) PREDICTIVE SPEECH SIGNAL CODING

(75) Inventors: Koen Bernard Vos, San Francisco, CA (US); Soren Skak Jensen, Stockholm (SE)

(73) Assignee: Skype, Dublin (IE)

( * ) Notice: Subject to any disclaimer, the term of this patent is extended or adjusted under 35 U.S.C. 154(b) by 881 days.

(21) Appl. No.: 12/455,478

(22) Filed: Jun. 2, 2009

(65) Prior Publication Data

US 2010/0174537 A1 Jul. 8, 2010

(30) Foreign Application Priority Data

Jan. 6, 2009 (GB) ..... 0900142.1

(51) Int. Cl.
*G10L 19/04* (2006.01)
*G10L 19/08* (2006.01)

(52) U.S. Cl.
USPC ..... 704/219; 704/223; 704/264

(58) Field of Classification Search ..... None
See application file for complete search history.

(56) References Cited

U.S. PATENT DOCUMENTS

| | | | |
|---|---|---|---|
| 4,857,927 | A | 8/1989 | Takabayashi |
| 5,125,030 | A | 6/1992 | Nomura et al. |
| 5,240,386 | A | 8/1993 | Amin et al. |
| 5,253,269 | A | 10/1993 | Gerson et al. |
| 5,327,250 | A | 7/1994 | Ikeda |
| 5,357,252 | A | 10/1994 | Ledzius et al. |
| 5,487,086 | A | 1/1996 | Bhaskar |
| 5,646,961 | A | 7/1997 | Shoham et al. |
| 5,649,054 | A | 7/1997 | Oomen et al. |
| 5,680,508 | A | 10/1997 | Liu |
| 5,699,382 | A | 12/1997 | Shoham et al. |
| 5,774,842 | A | 6/1998 | Nishio et al. |
| 5,867,814 | A | 2/1999 | Yong |
| 6,104,992 | A | 8/2000 | Gao et al. |
| 6,122,608 | A | 9/2000 | McCree |
| 6,173,257 | B1 | 1/2001 | Gao |

(Continued)

FOREIGN PATENT DOCUMENTS

| | | |
|---|---|---|
| CN | 1255226 | 5/2000 |
| CN | 1653521 | 8/2005 |

(Continued)

OTHER PUBLICATIONS

Notification of Transmittal of the International Search Report and the Written Opinion of the International Searching Authority, or the Declaration for Application No. PCT/EP2010/050057, dated Jun. 24, 2010.

(Continued)

*Primary Examiner* — Talivaldis Ivars Smits
(74) *Attorney, Agent, or Firm* — Wolfe-SBMC

(57) ABSTRACT

A method, system and computer program for encoding speech according to a source-filter model. The method comprises deriving a spectral envelope signal representative of a modelled filter and a first remaining signal representative of a modelled source signal, and deriving a second remaining signal from the first remaining signal by, at intervals during the encoding: exploiting a correlation between approximately periodic portions in the first remaining signal to generate a predicted version of a later portion from a stored version of an earlier portion, and using the predicted-version of the later portion to remove an effect of said periodicity from the first remaining signal. The method further comprises, once every number of intervals, transforming the stored version of the earlier portion of the first remaining signal prior to generating the predicted version of the respective later portion.

20 Claims, 13 Drawing Sheets

U.S. PATENT DOCUMENTS

| | | | |
|---|---|---|---|
| 6,188,980 | B1 | 2/2001 | Thyssen |
| 6,260,010 | B1 | 7/2001 | Gao et al. |
| 6,363,119 | B1 | 3/2002 | Oami |
| 6,408,268 | B1 | 6/2002 | Tasaki |
| 6,456,964 | B2 | 9/2002 | Manjunath et al. |
| 6,470,309 | B1 | 10/2002 | McCree |
| 6,493,665 | B1 | 12/2002 | Su et al. |
| 6,502,069 | B1 | 12/2002 | Grill et al. |
| 6,523,002 | B1 | 2/2003 | Gao et al. |
| 6,574,593 | B1 | 6/2003 | Gao et al. |
| 6,751,587 | B2 | 6/2004 | Thyssen et al. |
| 6,757,649 | B1 | 6/2004 | Gao et al. |
| 6,757,654 | B1 | 6/2004 | Westerlund et al. |
| 6,775,649 | B1 | 8/2004 | DeMartin |
| 6,862,567 | B1 | 3/2005 | Gao |
| 6,996,523 | B1 | 2/2006 | Bhaskar et al. |
| 7,136,812 | B2 | 11/2006 | Manjunath et al. |
| 7,149,683 | B2 | 12/2006 | Jelinek |
| 7,151,802 | B1 | 12/2006 | Bessette et al. |
| 7,171,355 | B1 | 1/2007 | Chen |
| 7,496,505 | B2 | 2/2009 | Manjunath et al. |
| 7,505,594 | B2 | 3/2009 | Mauro |
| 7,684,981 | B2 | 3/2010 | Thumpudi et al. |
| 7,869,993 | B2 | 1/2011 | Ojala |
| 7,873,511 | B2 | 1/2011 | Herre et al. |
| 8,036,887 | B2 | 10/2011 | Yasunaga et al. |
| 8,069,040 | B2 | 11/2011 | Vos |
| 8,078,474 | B2 | 12/2011 | Vos et al. |
| 8,392,178 | | 3/2013 | Vos |
| 8,396,706 | | 3/2013 | Vos |
| 2001/0001320 | A1 | 5/2001 | Heinen et al. |
| 2001/0005822 | A1 | 6/2001 | Fujii et al. |
| 2001/0039491 | A1 | 11/2001 | Yasunaga et al. |
| 2002/0032571 | A1 | 3/2002 | Leung et al. |
| 2002/0099540 | A1 | 7/2002 | Yasunaga et al. |
| 2002/0120438 | A1 | 8/2002 | Lin |
| 2003/0200092 | A1 | 10/2003 | Gao et al. |
| 2004/0102969 | A1 | 5/2004 | Manjunath et al. |
| 2005/0141721 | A1 | 6/2005 | Aarts et al. |
| 2005/0278169 | A1 | 12/2005 | Hardwick |
| 2005/0285765 | A1 | 12/2005 | Suzuki et al. |
| 2006/0074643 | A1 | 4/2006 | Lee et al. |
| 2006/0235682 | A1 | 10/2006 | Yasunaga et al. |
| 2006/0271356 | A1 | 11/2006 | Vos |
| 2007/0043560 | A1 | 2/2007 | Lee |
| 2007/0055503 | A1 | 3/2007 | Chu et al. |
| 2007/0088543 | A1 | 4/2007 | Ehara |
| 2007/0100613 | A1 | 5/2007 | Yasunaga et al. |
| 2007/0136057 | A1 | 6/2007 | Phillips |
| 2007/0225971 | A1 | 9/2007 | Bessette |
| 2007/0255561 | A1 | 11/2007 | Su et al. |
| 2008/0004869 | A1 | 1/2008 | Herre et al. |
| 2008/0015866 | A1 | 1/2008 | Thyssen et al. |
| 2008/0091418 | A1 | 4/2008 | Laaksonen et al. |
| 2008/0126084 | A1 | 5/2008 | Lee et al. |
| 2008/0140426 | A1 | 6/2008 | Kim et al. |
| 2008/0154588 | A1 | 6/2008 | Gao |
| 2008/0275698 | A1 | 11/2008 | Yasunaga et al. |
| 2009/0043574 | A1 | 2/2009 | Gao et al. |
| 2009/0222273 | A1 | 9/2009 | Massaloux et al. |
| 2010/0174531 | A1 | 7/2010 | Bernard |
| 2010/0174532 | A1 | 7/2010 | Vos et al. |
| 2010/0174534 | A1 | 7/2010 | Vos |
| 2010/0174542 | A1 | 7/2010 | Vos |
| 2010/0174547 | A1 | 7/2010 | Vos |
| 2011/0077940 | A1 | 3/2011 | Vos et al. |
| 2011/0173004 | A1 | 7/2011 | Bessette et al. |

FOREIGN PATENT DOCUMENTS

| | | | |
|---|---|---|---|
| EP | 0501421 | | 9/1992 |
| EP | 0550990 | | 7/1993 |
| EP | 0610906 | | 8/1994 |
| EP | 0 724 252 | A2 | 7/1996 |
| EP | 0720145 | | 7/1996 |
| EP | 0849724 | | 6/1998 |
| EP | 0877355 | | 11/1998 |
| EP | 0957472 | | 11/1999 |
| EP | 1093116 | | 4/2001 |
| EP | 1 255 244 | A1 | 11/2002 |
| EP | 1326235 | | 7/2003 |
| EP | 1 758 101 | A1 | 2/2007 |
| EP | 1903558 | | 3/2008 |
| GB | 2466669 | | 7/2010 |
| GB | 2466670 | | 7/2010 |
| GB | 2466671 | | 7/2010 |
| GB | 2466672 | | 7/2010 |
| GB | 2466673 | | 7/2010 |
| GB | 2466674 | | 7/2010 |
| GB | 2466675 | | 7/2010 |
| JP | 1205638 | | 10/1987 |
| JP | 2287400 | | 4/1989 |
| JP | 4312000 | | 4/1991 |
| JP | 7306699 | | 5/1994 |
| JP | 2007279754 | | 10/2007 |
| WO | WO 91/03790 | | 3/1991 |
| WO | WO-9403988 | | 2/1994 |
| WO | WO-9518523 | | 7/1995 |
| WO | WO-9918565 | | 4/1999 |
| WO | WO-9963521 | | 12/1999 |
| WO | WO 01/03122 | A1 | 1/2001 |
| WO | WO 01/91112 | A1 | 11/2001 |
| WO | WO 03/052744 | A2 | 6/2003 |
| WO | WO-2005009019 | | 1/2005 |
| WO | WO-2008046492 | | 4/2008 |
| WO | WO-2008056775 | | 5/2008 |
| WO | WO-2010079163 | | 7/2010 |
| WO | WO-2010079164 | | 7/2010 |
| WO | WO-2010079165 | | 7/2010 |
| WO | WO-2010079166 | | 7/2010 |
| WO | WO-2010079167 | | 7/2010 |
| WO | WO-2010079170 | | 7/2010 |
| WO | WO-2010079171 | | 7/2010 |

OTHER PUBLICATIONS

"Coding of Speech at 8 kbit/s Using Conjugate-Structure Algebraic-Code-Excited Linear-Prediction (CS-ACELP)", *International Telecommunication Union, ITUT*, (1996), 39 pages.

"International Search Report and Written Opinion", Application No. PCT/EP2010/050060, (Apr. 14, 2010), 14 pages.

"International Search Report and Written Opinion", Application No. PCT/EP2010/050052, (Jun. 21, 2010), 13 pages.

"International Search Report and Written Opinion", Application No. PCT/EP2010/050053, (May 17, 2010), 17 pages.

"International Search Report and Written Opinion", Application No. PCT/EP2010/050061, (Apr. 12, 2010), 13 pages.

"International Search Report and Written Opinion", Application No. PCT/EP2010/050051, (Mar. 15, 2010), 13 pages.

"International Search Report and Written Opinion", Application No. PCT/EP2010/050056, (Mar. 29, 2010), 8 pages.

"Non-Final Office Action", U.S. Appl. No. 12/455,632, (Feb. 6, 2012), 18 pages.

"Non-Final Office Action", U.S. Appl. No. 12/586,915, (May 8, 2012), 10 pages.

"Notice of Allowance", U.S. Appl. No. 12/455,632, (May 15, 2012), 7 pages.

"Search Report", Application No. GB 0900139.7, (Apr. 17, 2009), 3 pages.

"Search Report", Application No. GB 0900141.3, (Apr. 30, 2009), 3 pages.

"Search Report", Application No. GB 0900144.7, (Apr. 24, 2009), 2 pages.

"Search Report", Application No. GB0900143.9, (Apr. 28, 2009), 1 page.

"Search Report", Application No. GB0900145.4, (Apr. 27, 2009), 1 page.

"Wideband Coding of Speech at Around 1 kbit/sUsing Adaptive Multi-rate Wideband (AMR-WB)", *International Telecommunication Union G.722.2*, (2002), pp. 1-65.

Bishnu, S et al., "Predictive Coding of Speech Signals and Error Criteria", *IEEE, Transactions on Acoustics, Speech and Signal Processing, ASSP 27*(3), (1979), pp. 247-254.

Chen, Juin-Hwey "Novel Codec Structures for Noice Feedback Coding of Speech", *IEEE*, (2006), pp. 681-684.
Chen, L "Subframe Interpolation Optimized Coding of LSF Parameters", *IEEE*, (Jul. 2007), pp. 725-728.
Denckla, Ben "Subtractive Dither for Internet Audio", *Journal of the Audio Engineering Society*, vol. 46, Issue 7/8, (Jul. 1998), pp. 654-656.
Ferreira, C R., et al., "Modified Interpolation of LSFs Based on Optimization of Distortion Measures", *IEEE*, (Sep. 2006), pp. 777-782.
Gerzon, et al., "A High-Rate Buried-Data Channel for Audio CD", Journal of Audio Engineering Society, vol. 43, No. 1/2,(Jan. 1995), 22 pages.
Haagen, J et al., "Improvements in 2.4 KBPS High-Quality Speech Coding", *IEEE*, (Mar. 1992), pp. 145-148.
Islam, T et al., "Partial-Energy Weighted Interpolation of Linear Prediction Coefficients", *IEEE*, (Sep. 2000), pp. 105-107.
Jayant, N S., et al., "The Application of Dither to the Quantization of Speech Signals", *Program of the 84th Meeting of the Acoustical Society of America*. (Abstract Only), (Nov.-Dec. 1972), pp. 1293-1304.
Lupini, Peter et al., "A Multi-Mode Variable Rate Celp Coder Based on Frame Classification", *Proceedings of the International Conference on Communications* (*ICC*), *IEEE 1*, (1993), pp. 406-409.
Mahe, G et al., "Quantization Noise Spectral Shaping in Instantaneous Coding of Spectrally Unbalanced Speech Signals", *IEEE, Speech Coding Workshop*, (2002), pp. 56-58.
Makhoul, John et al., "Adaptive Noise Spectral Shaping and Entropy Coding of Speech", (Feb. 1979),pp. 63-73.
Martins Da Silva, L et al., "Interpolation-Based Differential Vector Coding of Speech LSF Parameters", *IEEE*, (Nov. 1996), pp. 2049-2052.
Rao, A V., et al., "Pitch Adaptive Windows for Improved Excitation Coding in Low-Rate CELP Coders", *IEEE Transactions on Speech and Audio Processing*, (Nov. 2003), pp. 648-659.
Salami, R "Design and Description of CS-ACELP: A Toll Quality 8 kb/s Speech Coder", *IEEE*, 6(2), (Mar. 1998), pp. 116-130.
Search Report for GB0900142.1, date of mailing Apr. 21, 2009.
"Foreign Office Action", Great Britain Application No. 0900145.4, (May 28, 2012), 2 pages.
"Non-Final Office Action", U.S. Appl. No. 12/455,100, (Jun. 8, 2012), 8 pages.
"Non-Final Office Action", U.S. Appl. No. 12/455,157, (Aug. 6, 2012), 15 pages.
"Non-Final Office Action", U.S. Appl. No. 12/455,632, (Oct. 18, 2011), 14 pages.
"Non-Final Office Action", U.S. Appl. No. 12/455,632, (Aug. 22, 2012), 14 pages.
"Non-Final Office Action", U.S. Appl. No. 12/455,712, (Jun. 20, 2012), 8 pages.
"Non-Final Office Action", U.S. Appl. No. 12/455,752, (Jun. 15, 2012), 8 pages.
"Non-Final Office Action", U.S. Appl. No. 12/586,915, (Sep. 25, 2012), 10 pages.
"Examination Report under Section 18(3)", Great Britain Application No. 0900143.9, (May 21, 2012), 2 pages.
"Final Office Action", U.S. Appl. No. 12/455,100, (Oct. 4, 2012), 5 pages.
"Final Office Action", U.S. Appl. No. 12/455,752, (Nov. 23, 2012), 8 pages.
"Non-Final Office Action", U.S. Appl. No. 12/583,998, (Oct. 18, 2012), 16 pages.
"Notice of Allowance", U.S. Appl. No. 12/455,157, (Nov. 29, 2012), 9 pages.
"Notice of Allowance", U.S. Appl. No. 12/455,712, (Oct. 23, 2012), 7 pages.
"Examination Report", GB Application No. 0900141.3, (Oct. 8, 2012), 2 pages.
"Supplemental Notice of Allowance", U.S. Appl. No. 12/455,712, (Dec. 19, 2012), 2 pages.
"Final Office Action", U.S. Appl. No. 12/455,632, (Jan. 18, 2013), 15 pages.
"Foreign Office Action", CN Application No. 201080010208.1, (Dec. 28, 2012), 7 pages.
"Notice of Allowance", U.S. Appl. No. 12/455,100, (Feb. 5, 2013), 4 Pages.
"Notice of Allowance", Application No. 12/586,915, (Jan. 22, 2013), 8 pages.
"Supplemental Notice of Allowance", U.S. Appl. No. 12/455,157, (Jan. 22, 2013), 2 pages.
"Supplemental Notice of Allowance", U.S. Appl. No. 12/455,157, (Feb. 8, 2013), 2 pages.
"Supplemental Notice of Allowance", U.S. Appl. No. 12/455,712, (Jan. 14, 2013), 2 pages.
"Supplemental Notice of Allowance", U.S. Appl. No. 12/455,712, (Feb. 5, 2013), 2 pages.

PREDICTIVE SPEECH SIGNAL CODING

RELATED APPLICATION

This application claims priority under 35 U.S.C. §119 or 365 to Great Britain Application No. 0900142.1, filed Jan. 6, 2009. The entire teachings of the above application are incorporated herein by reference.

FIELD OF THE INVENTION

The present invention relates to the encoding of speech for transmission over a transmission medium, such as by means of an electronic signal over a wired connection or electromagnetic signal over a wireless connection.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal with each period corresponds to a respective "pitch pulse" comprising a series of peaks of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising a pitch period of four peaks which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*. The short-term filter works by removing short-term correlations (i.e. short term compared to the pitch period), leading to an LPC residual with less energy than the speech signal.

The spectral envelope signal and the source signal are each encoded separately for transmission. In the illustrated example, each subframe 106 would contain: (i) a set of parameters representing the spectral envelope 204; and (ii) a set of parameters representing the pulses of the source signal 202.

To improve the encoding of the source signal, its periodicity may be exploited. To do this, a long-term prediction (LTP) analysis is used to determine the correlation of the LPC residual signal with itself from one period to the next, i.e. the correlation between the LPC residual signal at the current time and the LPC residual signal after one period at the current pitch lag (correlation being a statistical measure of a degree of relationship between groups of data, in this case the degree of repetition between portions of a signal). In this context the source signal can be said to be "quasi" periodic in that on a timescale of at least one correlation calculation it can be taken to have a meaningful period which is approximately (but not exactly) constant; but over many such calculations then the period and form of the source signal may change more significantly. A set of parameters derived from this correlation are determined to at least partially represent the source signal for each subframe. The set of parameters for each subframe is typically a set of coefficients C of a series, which form a respective vector $C_{LTP}=(C_1, C_2, \ldots C_i)$.

The effect of this inter-period correlation is then removed from the LPC residual, leaving an LTP residual signal representing the source signal with the effect of the correlation between pitch periods removed. To represent the source signal, the LTP vectors and LTP residual signal are encoded separately for transmission.

The sets of LPC parameters, the LTP vectors and the LTP residual signal are each quantised prior to transmission (quantisation being the process of converting a continuous range of values into a set of discrete values, or a larger approximately continuous set of discrete values into a smaller set of discrete values). The advantage of separating out the LPC residual signal into the LTP vectors and LTP residual signal is that the LTP residual typically has a lower energy than the LPC residual, and so requires fewer bits to quantize.

So in the illustrated example, each subframe 106 would comprise: (i) a quantised set of LPC parameters representing the spectral envelope, (ii)(a) a quantised LTP vector related to the correlation between pitch periods in the source signal, and (ii)(b) a quantised LTP residual signal representative of the source signal with the effects of this inter-period correlation removed.

FIG. 3*a* shows a diagram of a linear predictive speech encoder 300 comprising an LPC synthesis filter 306 having a short-term predictor 308 and an LTP synthesis filter 304 having a long-term predictor 310. The output of the short-term predictor 308 is subtracted from the speech input signal to produce an LPC residual signal. The output of the long-term predictor 310 is subtracted from the LPC residual signal to create an LTP residual signal. The LTP residual signal is quantized by a quantizer 302 to produce an excitation signal, and to produce corresponding quantisation indices for transmission to a decoder to allow it to recreate the excitation signal. The quantizer 302 can be a scalar quantizer, a vector quantizer, an algebraic codebook quantizer, or any other suitable quantizer. The output of a long term predictor 310 in the LTP synthesis filter 304 is added to the excitation signal, which creates the LPC excitation signal. The LPC excitation signal is input to the long-term predictor 310, which is a strictly causal moving average (MA) filter controlled by the pitch lag and quantized LTP coefficients. The output of a short term predictor 308 in the LPC synthesis filter 306 is added to the LPC excitation signal, which creates the quantized output signal for feedback for subtraction the input. The quantized output signal is input to the short-term predictor 308, which is a strictly causal MA filter controlled by the quantized LPC coefficients.

FIG. 3*b* shows a linear predictive speech decoder 350. Quantization indices are input to an excitation generator 352 which generates an excitation signal. The output of a long term predictor 360 in a LTP synthesis filter 354 is added to the excitation signal, which creates the LPC excitation signal. The LPC excitation signal is input to the long-term predictor 360, which is a strictly causal MA filter controlled by the pitch lag and quantized LTP coefficients. The output of a short term predictor 358 in a short-term synthesis filter 356 is added to the LPC excitation signal, which creates the quantized output signal. The quantized output signal is input to the short-term predictor 358, which is a strictly causal MA filter controlled by the quantized LPC coefficients.

The encoder 300 works by using an LTP analysis (not shown) to determine a correlation between successive received pitch pulses in the LPC residual signal, then passing coefficients of that correlation to the LTP synthesis filter where they are used to predict a version of the later of those pitch pulses from a stored version of the earlier of those pitch pulses based on the correlation. The predicted version of the later pitch pulse is fed back to the input where it is subtracted from the corresponding portion in the actual LPC residual signal, thus removing the effect of the periodicity and thereby deriving an LTP residual signal. For example, referring to FIG. 2*a*, a correlation is determined between the pulses of periods $P_1$ and $P_2$ then used to predict the pulse of $P_2$, and the predicted version of $P_2$ is then subtracted from the actual version to leave a residual which represents the degree to which $P_1$ was not correlated with $P_2$ and so the degree to which the LPC signal was not entirely periodic. Put another way, the LTP synthesis filter uses a long-term prediction to effectively remove or reduce the pitch pulses from the LPC residual signal, leaving an LTP residual signal having lower energy than the LPC residual.

However, it would be desirable to improve some aspects of the LTP prediction, or of other such prediction based on a correlation between portions of a signal representing a source signal of a source-filter model.

SUMMARY

According to one aspect of the present invention, there is provided a method of encoding speech according to a source-filter model whereby speech is modelled to comprise a source signal filtered by a time-varying filter, the method comprising: receiving a speech signal; from the speech signal, deriving a spectral envelope signal representative of the modelled filter and a first remaining signal representative of the modelled source signal, the first remaining signal comprising a plurality of successive portions having a degree of periodicity; deriving a second remaining signal from the first remaining signal by, at intervals during the encoding of said speech signal: exploiting a correlation between ones of said portions to generate a predicted version of a later of said portions from a stored version of an earlier of said portions, and using the predicted version of the later portion to remove an effect of said periodicity from the first remaining signal; and transmitting an encoded signal representing said speech signal based on the spectral envelope signal, said correlations and the second remaining signal; wherein the method further comprises, once every number of said intervals, transforming the stored version of the earlier portion of the first remaining signal prior to generating the predicted version of the respective later portion.

In embodiments, at one or more of said intervals, parameters used to derive the first remaining signal may be updated between deriving the respective earlier portion and generating the predicted version of the respective later portion; and said transformation may be performed at said one or more intervals and may comprise updating the stored version of the respective earlier portion of the first residual signal using the updated parameters.

The encoding may be performed over a plurality of frames each comprising a plurality of subframes, and each of said intervals may be a subframe; said deriving of the second remaining signal may be performed once per subframe whilst parameters used to derive the first remaining signal may be updated once per frame, hence at one subframe per frame then the predicted version of the later portion may be generated from the earlier portion as derived using a previous frame's parameters but used to remove said effect of periodicity from the first remaining signal as derived using a current frame's parameters; and said transformation of the stored version of the earlier portion may be performed at said one subframe per frame and may comprise updating the stored version of the respective earlier portion of the first residual signal using the current frame's parameters.

The method may comprise determining said correlations using at least one of an open-loop pitch analysis and a long-term prediction analysis, and at least one of those analyses may be based on a version of the first remaining signal derived using said updated parameters for both the previous and current frames.

Said transformation may be so as to result in a greater reduction in overall energy of the second remaining signal relative to the first remaining signal than without said transformation.

Said transformation may comprise re-whitening the stored version of the earlier portion.

The encoded signal may be transmitted as a plurality of packets each encoding a plurality of said intervals, and said transformation of the stored version of the earlier portion may be performed once per packet so as to reduce error propagation caused by potential packet loss in the transmission. Said transformation may be performed for the first interval of each packet.

Said transformation may be based on information about the packet loss in a channel used for said transmission.

Said transformation may comprise scaling down the stored version of the earlier portion by a scaling factor.

The scaling factor may be selected from one of a plurality of specified factors. Said specified factors may have substantially the values of 0.5, 0.7 and 0.95.

Said periodicity may correspond to a perceived pitch of the speech signal.

The derivation of said spectral envelope signal may be by linear predictive coding (LPC) such that said first remaining signal is an LPC residual signal.

Said stored versions of the earlier portions may be stored in the form of a quantized excitation corresponding to respective portions of said LPC residual signal.

Said derivation of the second remaining signal may be by long-term prediction (LTP) such that said second remaining signal is an LTP residual signal.

Each of said stored versions of the earlier portions may each comprises an LTP state.

According to another aspect of the present invention, there is provided a method of decoding an encoded signal comprising speech encoded according to a source-filter model whereby the speech is modelled to comprise a source signal filtered by a time-varying filter, the method comprising: receiving a encoded signal over a communication medium; from the encoded signal, determining a spectral envelope signal representative of the modelled filter; from the encoded signal, determining a second remaining signal; deriving a first remaining signal representative of the modelled source signal and comprising a plurality of successive portions having a degree of periodicity, by, at intervals during the decoding of said encoded signal: determining from the encoded signal information relating to a correlation between ones of said portions of the first remaining signal, using said information to generate a predicted version of a later of said portions based on a stored version of an earlier of said portions, and reconstructing a corresponding portion of the first remaining signal using the second remaining signal and said predicted version of the later portion; and generating a decoded speech signal based on the first excitation signal and spectral envelope signal, and outputting the decoded speech signal to an output device.

According to another aspect of the present invention, there is provided an encoder for encoding speech according to a source-filter model whereby speech is modelled to comprise a source signal filtered by a time-varying filter, the encoder comprising: an input arranged to receive a speech signal; a first signal processing module configured to derive, from the speech signal, a spectral envelope signal representative of the modelled filter and a first remaining signal representative of the modelled source signal, the first remaining signal comprising a plurality of successive portions having a degree of periodicity; a second signal processing module configured to derive a second remaining signal from the first remaining signal by, at intervals during the encoding of said speech signal: exploiting a correlation between ones of said portions to generate a predicted version of a later of said portions from a stored version of an earlier of said portions, and using the predicted version of the later portion to remove an effect of said periodicity from the first remaining signal; and an output arranged to transmit an encoded signal representing said speech signal based on the spectral envelope signal, said correlations and the second remaining signal; wherein the second signal processing module is further configured to transform, once every number of said intervals, the stored version of the earlier portion of the first remaining signal prior to generating the predicted version of the respective later portion.

According to another aspect of the present invention, there is provided a decoder for decoding an encoded signal comprising speech encoded according to a source-filter model whereby the speech is modelled to comprise a source signal filtered by a time-varying filter, the decoder comprising: an input arranged to receive a encoded signal; a first signal processing module configured to determine, from the encoded signal, a spectral envelope signal representative of the modelled filter; and a second signal processing module configured to determine, from the encoded signal, a second remaining signal; wherein the second signal processing module is further configured to derive a first remaining signal representative of the modelled source signal and comprising a plurality of successive portions having a degree of periodicity, by, at intervals during the decoding of said encoded signal: determining from the encoded signal information relating to a correlation between ones of said portions of the first remaining signal, using said information to generate a predicted version of a later of said portions based on a stored version of an earlier of said portions, and reconstructing a corresponding portion of the first remaining signal using the second remaining signal and said predicted version of the later portion; and the decoder further comprises an output module configured to generate a decoded speech signal based on the first excitation signal and spectral envelope signal, and output the decoded speech signal to an output device.

According to another aspect of the present invention, there is provided a computer program product for encoding speech according to a source-filter model whereby the speech is modelled to comprise a source signal filtered by a time-varying filter, the program comprising code arranged so as when executed on a processor to:

receive a speech signal;

from the speech signal, derive a spectral envelope signal representative of the modelled filter and a first remaining signal representative of the modelled source signal, the first remaining signal comprising a plurality of successive portions having a degree of periodicity;

derive a second remaining signal from the first remaining signal by, at intervals during the encoding of said speech signal: exploiting a correlation between ones of said portions to generate a predicted version of a later of said portions from a stored version of an earlier of said portions, and using the predicted version of the later portion to remove an effect of said periodicity from the first remaining signal;

transmit an encoded signal representing said speech signal based on the spectral envelope signal, said correlations and the second remaining signal; and once every number of said intervals, transform the stored version of the earlier portion of the first remaining signal prior to generating the predicted version of the respective later portion.

According to another aspect of the present invention, there is provided a computer program product for decoding an encoded signal comprising speech encoded according to a source-filter model whereby the speech is modelled to comprise a source signal filtered by a time-varying filter, the program comprising code arranged so as when executed on a processor to:

receive a encoded signal over a communication medium;

from the encoded signal, determine a spectral envelope signal representative of the modelled filter;

from the encoded signal, determine a second remaining signal;

derive a first remaining signal representative of the modelled source signal and comprising a plurality of successive portions having a degree of periodicity, by, at intervals during the decoding of said encoded signal: determining from the encoded signal information relating to a correlation between ones of said portions of the first remaining signal, using said information to generate a predicted version of a later of said portions based on a stored version of an earlier of said portions, and reconstructing a corresponding portion of the first remaining signal using the second remaining signal and said predicted version of the later portion; and generate a decoded speech signal based on the first excitation signal and spectral envelope signal, and output the decoded speech signal to an output device.

According to further aspects of the present invention, there are provided corresponding computer program products such as client application products.

According to another aspect of the present invention, there is provided a communication system comprising a plurality of end-user terminals each comprising a corresponding encoder and/or decoder.

BRIEF DESCRIPTION OF THE DRAWINGS

For a better understanding of the present invention and to show how it may be carried into effect, reference will now be made by way of example to the accompanying drawings in which.

DETAILED DESCRIPTION OF PREFERRED EMBODIMENTS

Figure 1A:
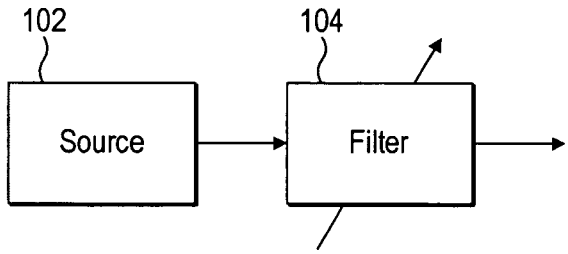
FIG. 1*a* is a schematic representation of a source-filter model of speech.

As discussed, long-term prediction (LTP) is a known technique in speech coding whereby correlations between pitch pulses are exploited to improve coding efficiency. In the encoder, for frames classified as voiced, a long term prediction filter uses one or more pitch lags and one or more LTP coefficients to compute an LTP residual signal from an LPC residual. The LTP residual has smaller variance and can thus be encoded more efficiently than the LPC residual. The pitch lags and LTP coefficients are sent to the decoder together with the coded LTP residual, or excitation. Here the excitation is used to reconstruct the LPC excitation signal, using an LTP synthesis filter. In speech codecs based on the Code Excited Linear Prediction (CELP) paradigm, the LTP state is sometimes called the adaptive codebook.

However, as discussed in more detail below, the long-term prediction process can itself introduce problems such as difficulties in the prediction or propagation of errors.

In preferred embodiments, the present invention overcomes such problems by providing a method for modifying the LTP state in predictive speech coding. The LTP state is the stored LPC residual or LPC excitation signal from the previous pitch period, from which the following pitch period is to be predicted in order to remove it from the current LPC residual signal and thus derive the LTP residual signal. More generally, the invention can apply to any situation where a first signal is derived to represent the source signal of a source-filter model of speech, and a second signal is then derived by calculating correlation between earlier and later portions of the first signal which have a degree of repetition therebetween. By transforming the stored earlier portion, it is possible to compensate for changes in the filter part of the source-filter model that would lead to an LTP residual signal having a greater energy that it should.

One particular problem with existing encoders is that fluctuations of the LPC coefficients from one frame to the next reduce the correlations between pitch pulses. This, in turn, leads to an LTP or other such residual signal having a greater energy than it should do, and therefore being less efficient to encode in that it requires more bits to quantize. The long-term prediction filter removes or reduces the pitch pulses in the LPC residual signal by predicting one pitch pulse based on the previous one. The LPC residual of one frame is typically computed based on quantized LPC coefficients that may differ from those used to compute the LPC residual of the next frame. Reasons for the difference in quantized LPC coefficients may be the natural evolution of the spectral envelope in speech, and numerical fluctuations in the estimation and quantization of the LPC coefficients. As the shape of a pitch pulse is influenced by the LPC coefficients, the difference in quantized LPC coefficients may cause the last pitch pulse of one frame to have a significantly different shape than the first pitch pulse of the next frame. Consequently, the last pitch pulses of a frame may be a poor basis for predicting the first pitch pulse of the next frame.

The LPC coefficients are typically updated at the start of a frame, and sometimes also during a frame, for example when interpolated LPC coefficients are used. For the duration of one pitch lag following an update of the LPC coefficients, the long-term predictor outputs a signal that is based on the LPC coefficients before the update of the LPC coefficients. However, during that time the long-term predictor output is subtracted, with the aim of minimizing an LPC residual signal based on the LPC coefficients after the update of the LPC coefficients. This creates an inconsistency, where the LTP state is not perfectly suited for minimizing the LTP residual. In particular, the shape of the pitch pulse in the LPC residual signal is influenced by the LPC coefficients, and after updating the LPC coefficients the LTP state may contain a pitch pulse with a different shape than the pitch pulse in the LPC residual. As a result, the long-term predictor is not able to create a long-term prediction signal that efficiently minimizes the LTP residual.

In embodiments of the present invention, problems of this kind can be solved by modifying the LTP state synchronously in encoder and decoder when LPC coefficients are updated. This improves the long-term prediction performance and thus improves coding efficiency. First a quantized speech signal is generated by inputting the LTP state into an LPC synthesis filter controlled by the LPC coefficients before the update of the LPC coefficients. Subsequently, a new LTP state is created by whitening the quantized speech signal with an LPC analysis filter controlled by the LPC coefficients after the update of the LPC coefficients. The LTP state is updated in this manner in encoder and decoder synchronously.

In this case, a preferred modification is to "re-whiten" the LTP state using the same whitening (LPC) coefficients as were used for generating the LPC residual ("whitening" is to equalize the LTP state to flatten its spectral density, so that its energy is more evenly spread across its frequency spectrum).

Note that this modification does not necessarily make the LTP more white: the preferred modification is to whiten the stored LTP state using the same, updated whitening (LPC) coefficients as used for generating the current LPC residual.

To elaborate, the whitening operation is done by the LPC analysis, and the LPC synthesis performs the reverse of a whitening operation. Therefore the LTP state was already whitened, but using the LPC coefficients of the previous frame. To compensate for this, the preferred modification is therefore to:

(i) undo the whitening from the previous coefficients by running the LPC excitation through an LPC synthesis filter controlled by the LPC coefficients of the previous frame (note that this was done already anyway in forming the quantized output signal of the previous frame), and (ii) subsequently whiten the LTP state again with the LPC coefficients of the current frame.

The result of this may actually make the LTP state slightly less white. Thus the modification may be referred to as a "re-whitening" (i.e. re-applying a whitening LPC analysis filter), rather than a whitening per se.

Figure 4E:
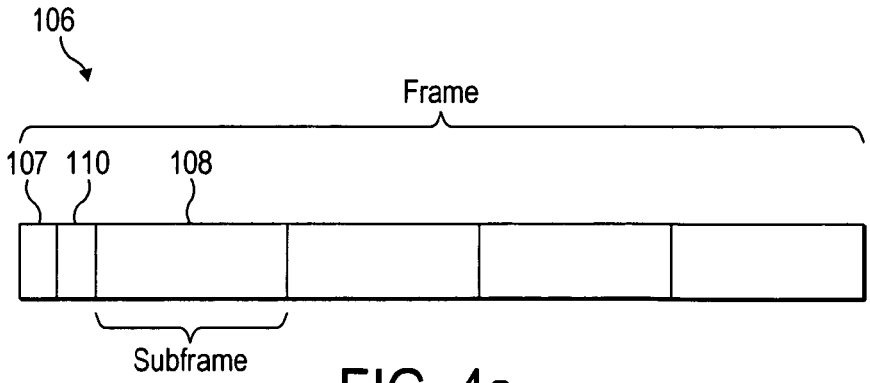
FIG. 4*e* is another schematic representation of a frame.
Figure 3A:
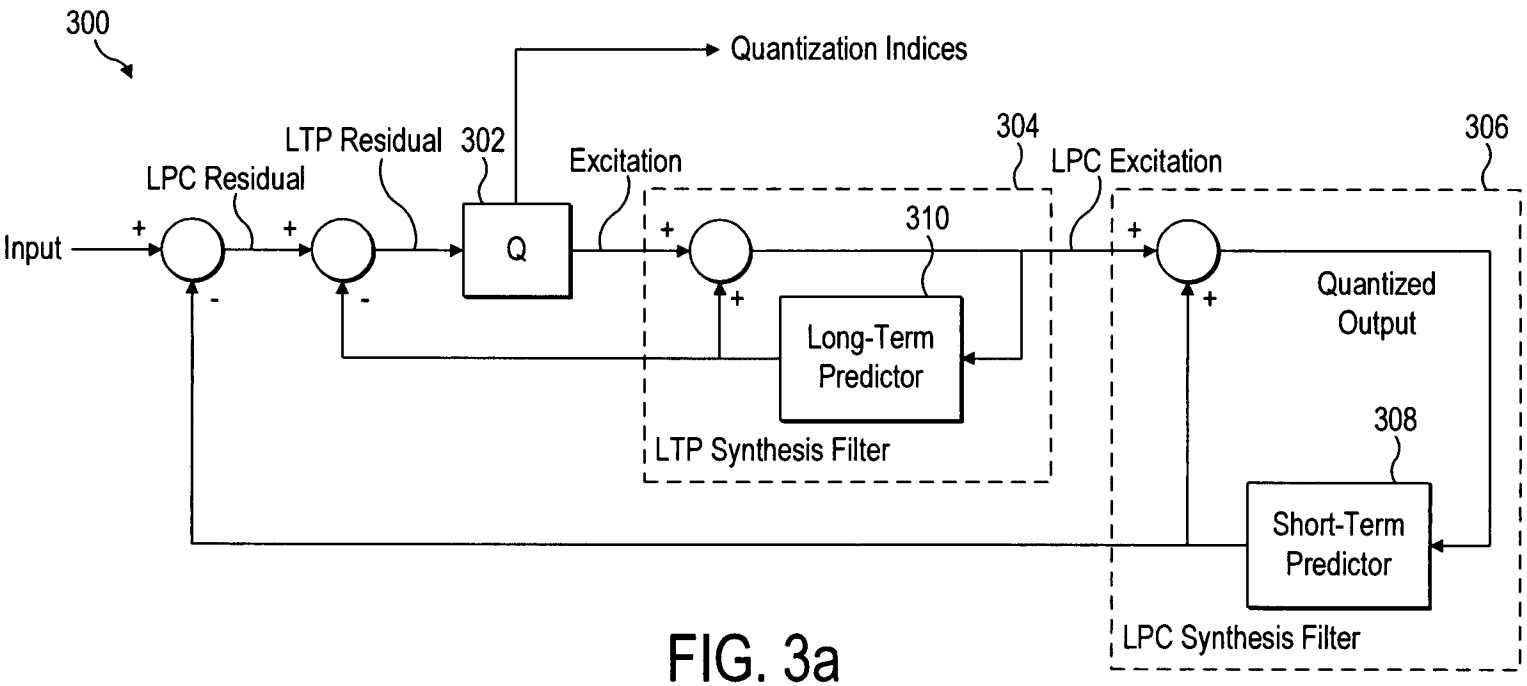
FIG. 3*a* is a schematic block diagram of an encoder.
Figure 3B:
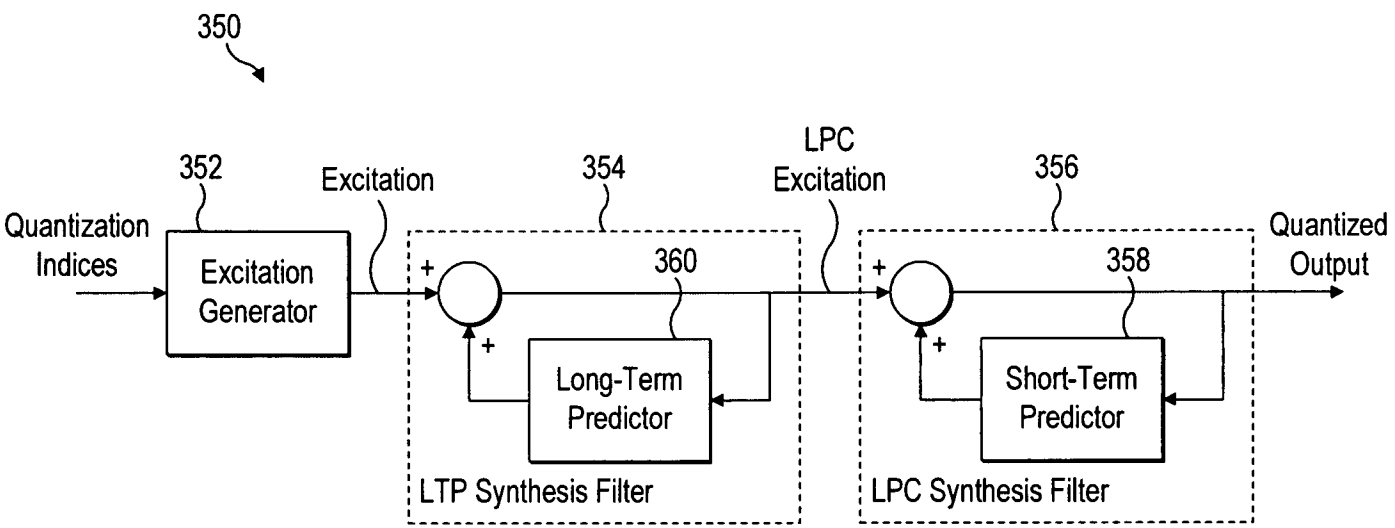
FIG. 3*b* is a schematic block diagram of a decoder.
Figure 4A:
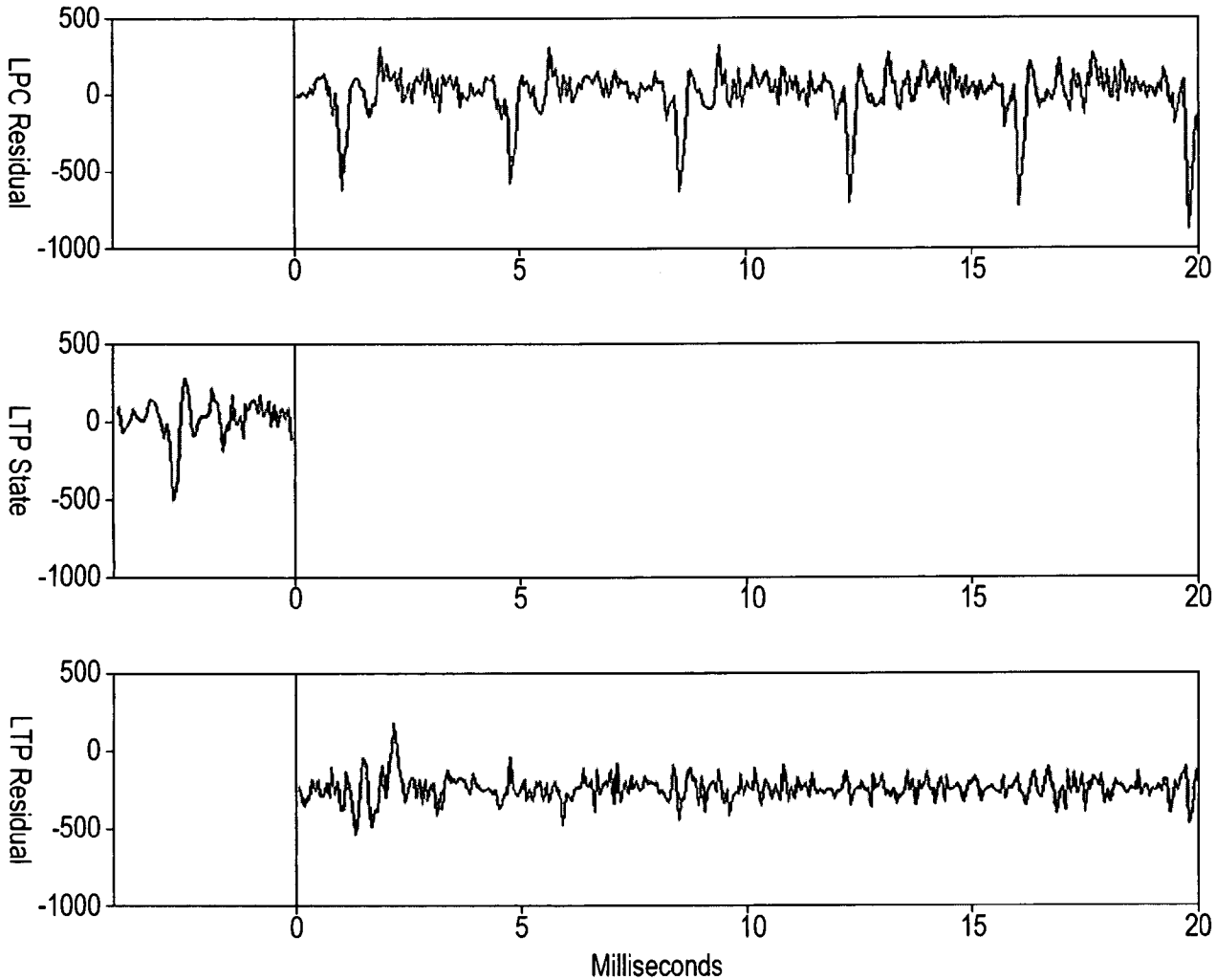
FIG. 4*a* shows graphs of an LPC residual, LTP state and LTP residual.

FIG. 4*a* shows the effect of different LCP coefficients used for generating the LTP state and LPC residual. The top graph shows an LPC residual for one frame of 20 milliseconds, containing six similarly shaped pitch pulses. The similarity allows a long term predictor to create an LTP residual with significantly less energy than the LPC residual. To predict each pitch pulse, the long term predictor uses a state containing the previous pitch pulse. However, for the first pitch pulse the LTP predictor uses an LTP state depending on the LPC coefficients from the previous frame. The LTP state is shown in the second graph, and contains a pitch pulse with different shape. As a result, the LTP residual shown in the bottom graph has more energy for the first pitch pulse than for the subsequent pitch pulses.

Figure 4B:
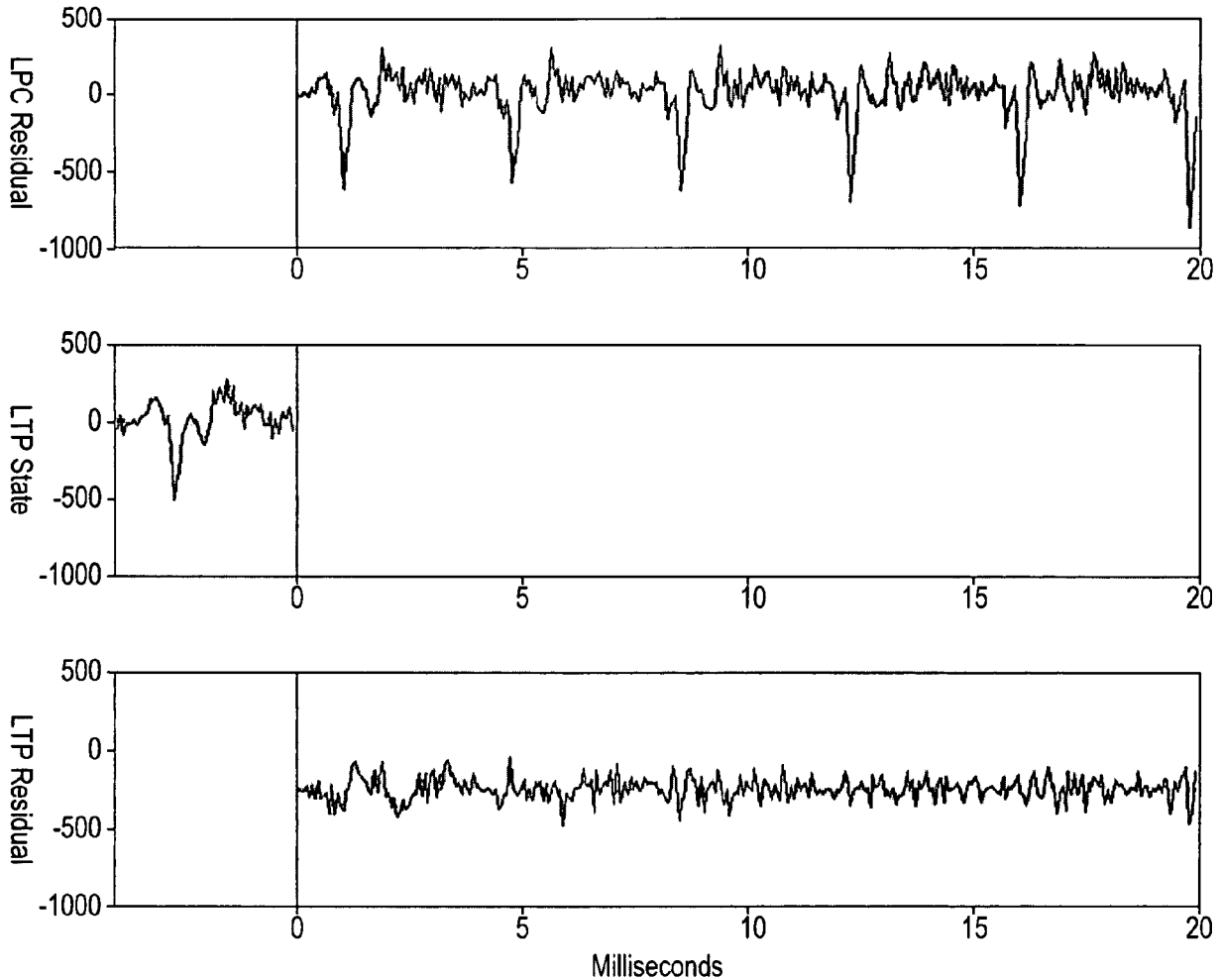
FIG. 4*b* shows further graphs of an LPC residual, LTP state and LTP residual.

FIG. 4*b* shows the same LPC residual in the top graph, but now the LTP state has been modified by first inputting it into an LPC synthesis filter controlled by the LPC coefficients from the previous frame, and then whitening the output from the LPC synthesis filter with an LPC analysis filter controlled by the LPC coefficients of the current frame. The result is an LTP state containing a pitch pulse that matches the first pitch pulse of the LPC residual better. Consequently, the LTP residual in the bottom graph contains less energy for the first pitch pulse than with the unmodified LTP state.

Because modifying the LTP state in the manner described typically leads to an LTP residual with less energy, the LTP residual can be coded more efficiently, thereby reducing the bitrate of the codec.

Figure 4C:
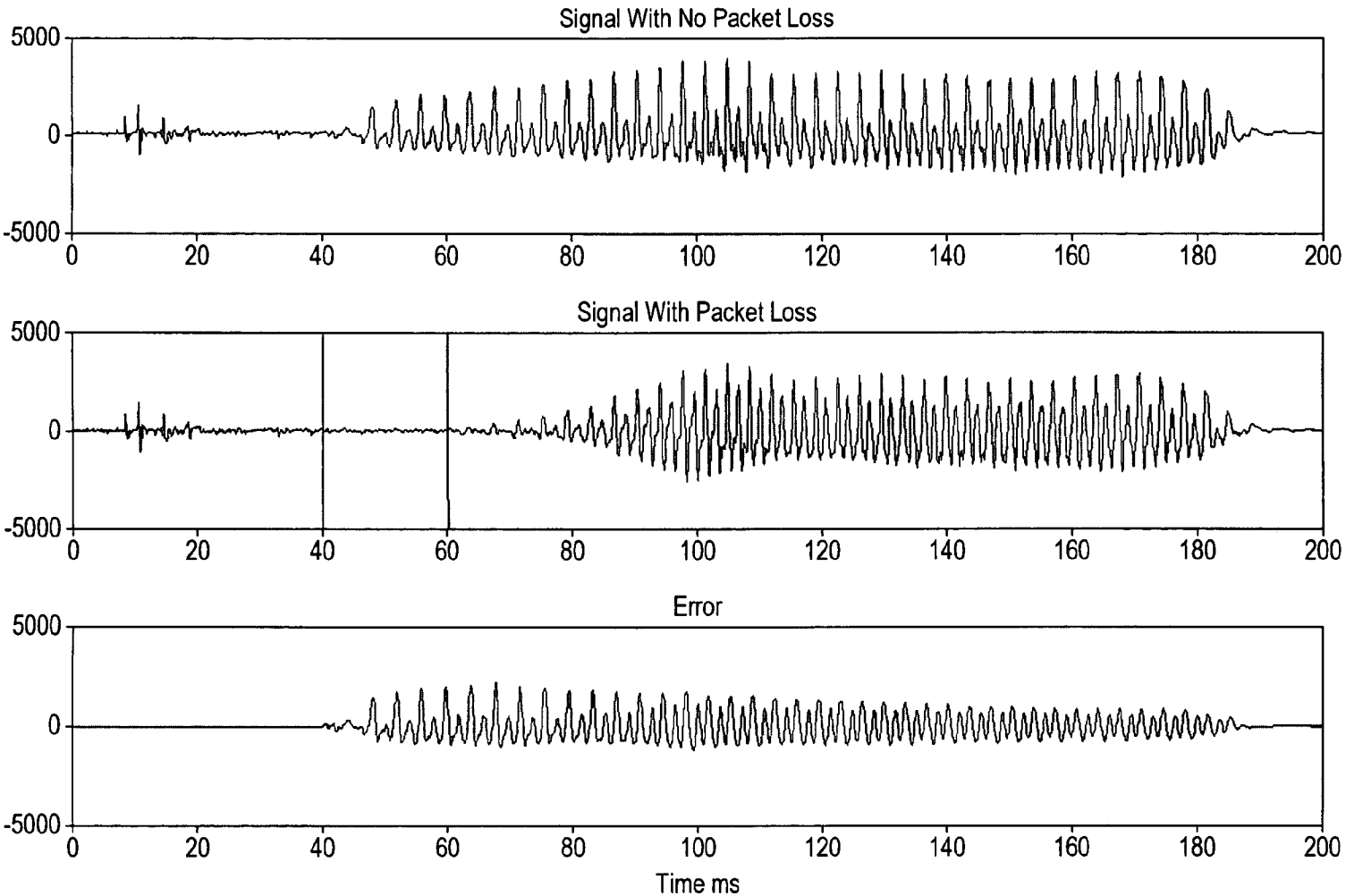
FIG. 4*c* shows graphs illustrating error propagation.

Another particular problem with existing encoders is packet loss error propagation. When the LTP coefficients are optimized without constraints to minimize the LTP residual energy, the LTP synthesis filter in the decoder (a time varying AR filter), often has a very long impulse response. This means that an error in the decoder, due to losing a packet can have effect over a long time. This effect is often called error propagation as the error from the lost frame propagates into future frames. The effect of such error propagation is illustrated in FIG. 4*c*. The top graph shows an error free decoded signal, the middle graph shows a decoded signal with a packet loss between the vertical lines, and the bottom graph shows the difference between the two decoded signals. As illustrated, the difference lasts much longer than the duration of the lost packet.

One approach to reduce the error propagation is to set constraints on the LTP coefficients so as to shorten the impulse response of the LTP synthesis filter. By doing this the coding gain from LTP is lowered resulting in a need for higher bit rate to maintain the output speech quality in lossless condition.

According to further embodiments of the present invention, the problem of error propagation can be reduced by down-scaling the LTP state synchronously in encoder and decoder. Preferably, error propagation is controlled by scaling down the LTP filter state in both encoder and decoder at the start of each new packet. This gives a better trade off between LTP prediction gain and packet loss error propagation, which translates to a better trade off between bitrate and packet loss sensitivity.

Figure 4D:
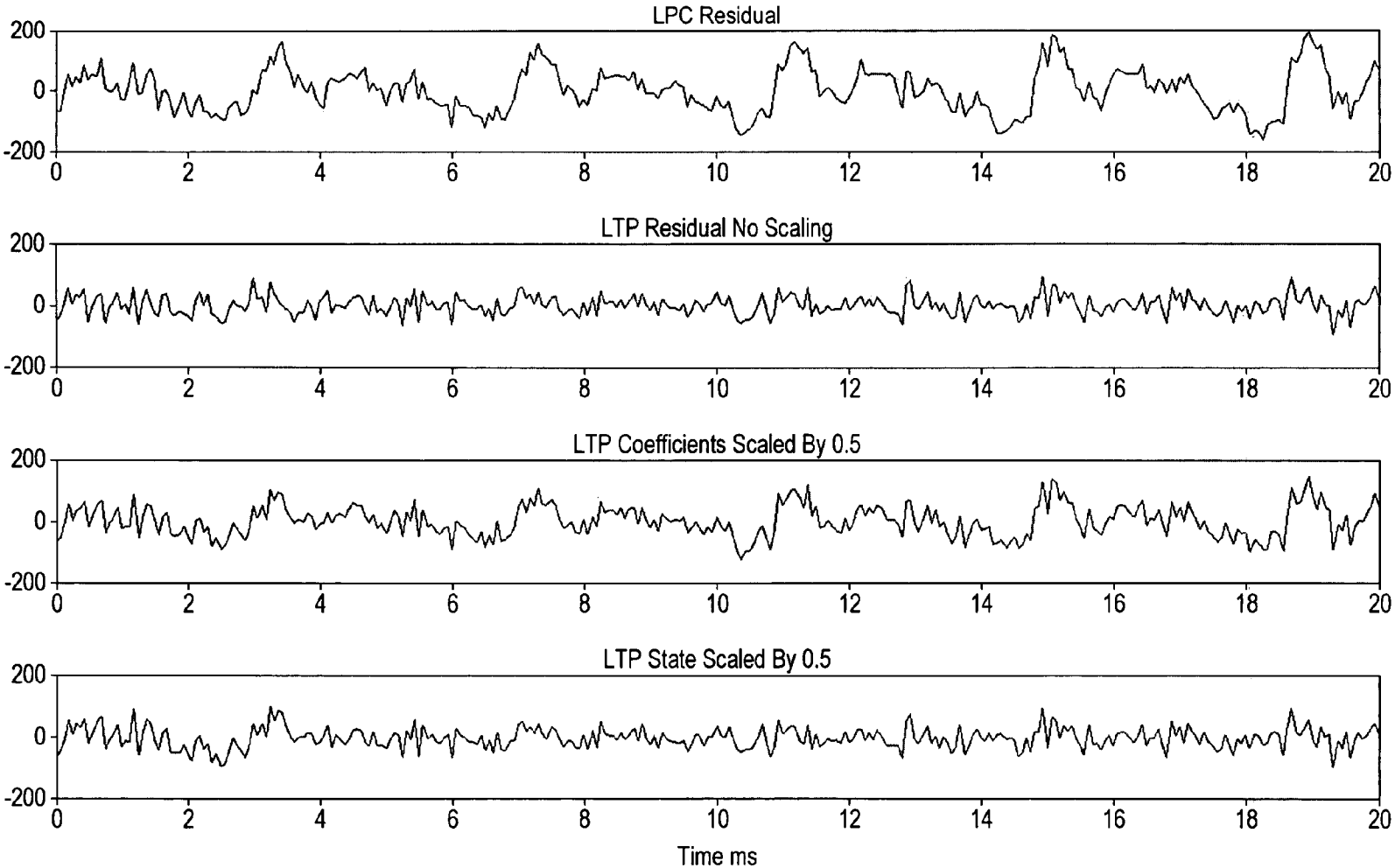
FIG. 4*d* shows graphs of an LTP residual according to a number of methods.

FIG. 4*d* illustrates different methods for limiting error propagation. The top graph shows one 20 ms frame of LPC residual. The other three graphs show one corresponding frame of LTP residual for three different methods. The second graph shows the LTP residual for unconstrained LTP coefficients. The LTP residual can be seen to be much reduced compared to the LPC residual. The third graph shows the LTP residual for scaled LTP coefficients scaled by 0.5. The LTP residual is less reduced than for the unconstrained method. The last graph shows the LTP residual for a scaled LTP state scaled by 0.5, with the optimal LTP coefficients used unaltered. The first pitch pulse is less reduced, similar to the LTP residual signal with scaled LTP coefficients. However, the remainder of the LTP residual is as much reduced as with the unconstrained method.

When more than one pitch pulse sits in a frame, downscaling the state only gives an energy increase (and thereby bit rate increase) for the first pitch pulse, and the following pitch pulses are coded as efficiently as with the unconstrained method. In contrast, scaling the gains reduces coding efficiency for all pitch pulses.

When the scaling is set to zero in order to avoid all error propagation, the method of scaling the LTP state is better than scaling the LTP coefficients, because of the higher coding efficiency for the signal after the first pitch pulse.

The inventors' experiments have found that scaling the state is also more efficient when the scaling is between zero and one.

Figure 1B:
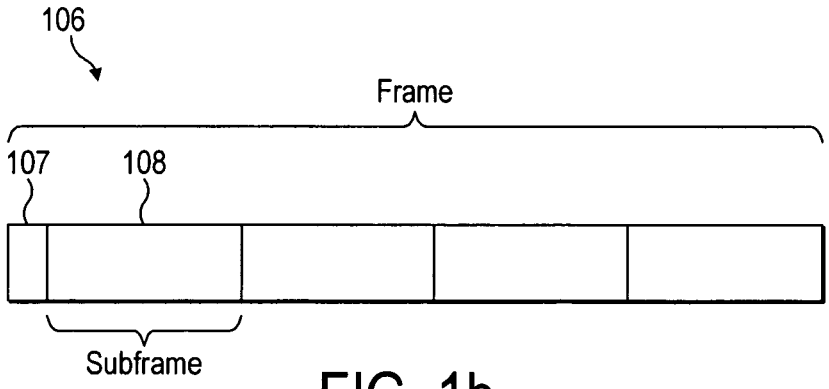
FIG. 1*b* is a schematic representation of a frame.
Figure 2A:
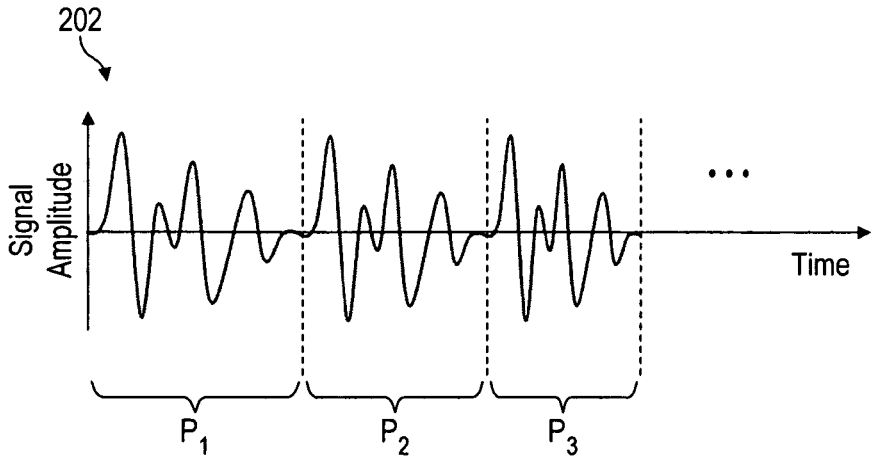
FIG. 2*a* is a schematic representation of a source signal.
Figure 2B:
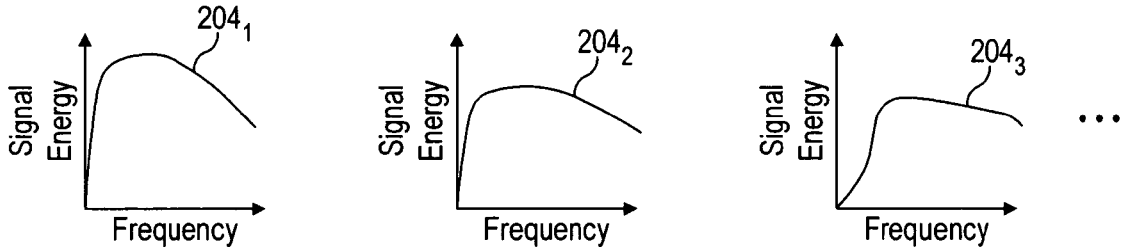
FIG. 2*b* is a schematic representation of variations in a spectral envelope.

The selected scaling value is indicated in the encoded signal to the decoder, preferably once per frame if one frame is encoded per packet. FIG. 4*e* is a schematic representation of a frame according to a preferred embodiment of the present invention. In addition to the classification flag 107, and subframes 108 as discussed in relation to FIG. 1*b*, the frame additionally comprises an index 110 of the scaling value selected to multiply the LTP state by.

Figure 5:
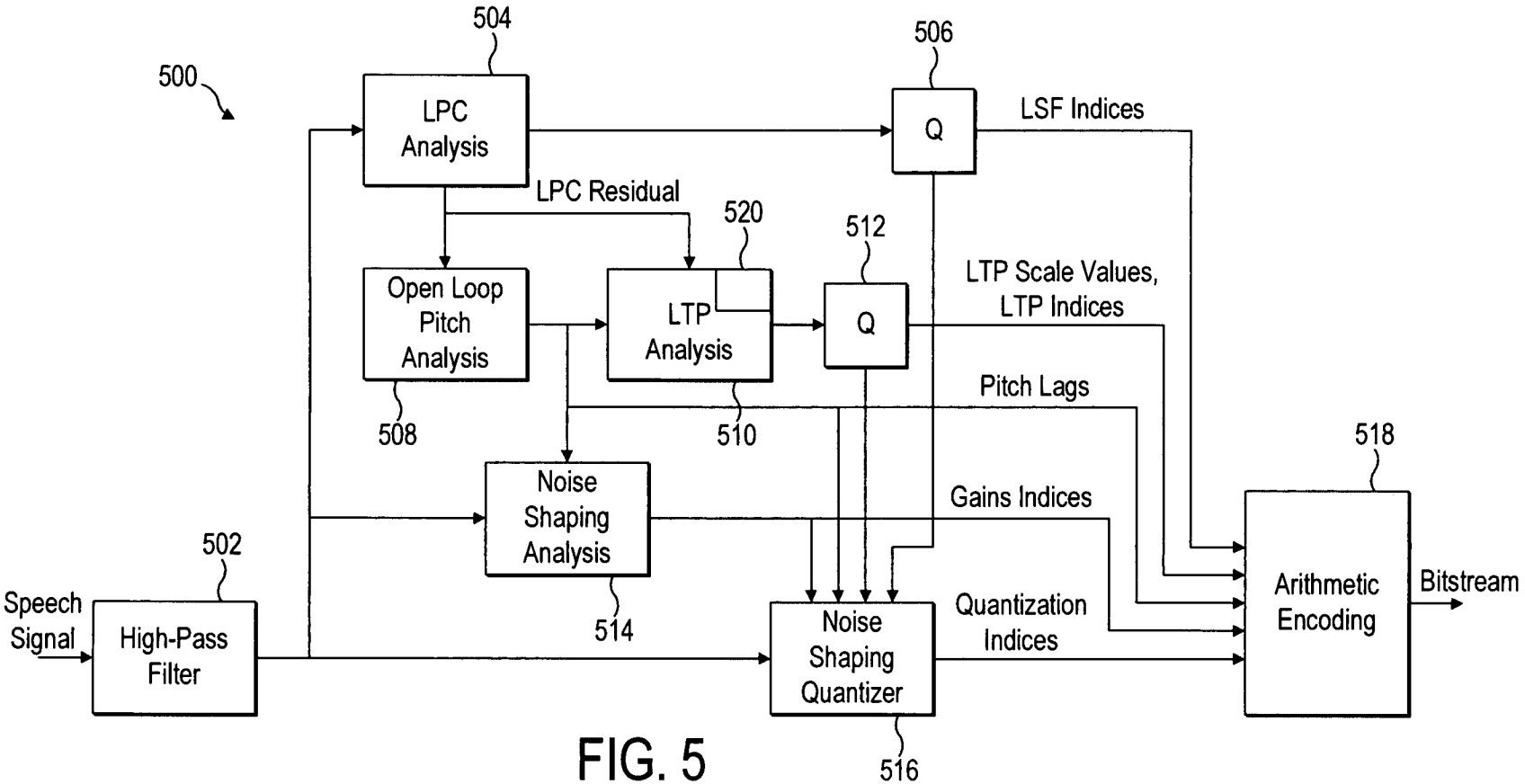
FIG. 5 is another schematic block diagram of an encoder.

An example of an encoder 500 for implementing the present invention is now described in relation to FIG. 5.

The encoder 500 comprises a high-pass filter 502, a linear predictive coding (LPC) analysis block 504, a first vector quantizer 506, an open-loop pitch analysis block 508, a long-term prediction (LTP) analysis block 510, a second vector quantizer 512, a noise shaping analysis block 514, a noise shaping quantizer 516, and an arithmetic encoding block 518. The LTP analysis block 510 comprises a scaling control module 520, which will be discussed later in relation to FIG. 6. The high pass filter 502 has an input arranged to receive an input speech signal from an input device such as a microphone, and an output coupled to inputs of the LPC analysis block 504, noise shaping analysis block 514 and noise shaping quantizer 516. The LPC analysis block has an output coupled to an input of the first vector quantizer 506, and the first vector quantizer 506 has outputs coupled to inputs of the arithmetic encoding block 518 and noise shaping quantizer 516. The LPC analysis block 504 has outputs coupled to inputs of the open-loop pitch analysis block 508 and the LTP analysis block 510. The LTP analysis block 510 has an output coupled to an input of the second vector quantizer 512, and the second vector quantizer 512 has outputs coupled to inputs of the arithmetic encoding block 518 and noise shaping quantizer 516. The open-loop pitch analysis block 508 has outputs coupled to inputs of the LTP 510 analysis block 510 and the noise shaping analysis block 514. The noise shaping analysis block 514 has outputs coupled to inputs of the arithmetic encoding block 518 and the noise shaping quantizer 516. The noise shaping quantizer 516 has an output coupled to an input of the arithmetic encoding block 518. The arithmetic encoding block 518 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitsream payload contains arithmetically encoded parameters, and has a bitrate that varies depending on a quality setting provided to the encoder and on the complexity and perceptual importance of the input signal.

The speech input signal is input to the high-pass filter 504 to remove frequencies below 80 Hz which contain almost no speech energy and may contain noise that can be detrimental to the coding efficiency and cause artifacts in the decoded output signal. The high-pass filter 504 is preferably a second order auto-regressive moving average (ARMA) filter.

The high-pass filtered input $X_{HP}$ is input to the linear prediction coding (LPC) analysis block 504, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

In one particularly advantageous embodiment, here the LPC residual is computed for the current frame, and also for the previous frame using the LPC coefficients derived for the current frame. The effect of this is to use an LPC residual generated with constant LPC coefficients in the open loop pitch analysis and LTP analysis. Having the last pitch pulse in the previous frame generated with the same LPC coefficients as the pitch pulses in the current frame improves the open loop pitch estimation and LTP analysis. This is particularly applicable when applying the re-whitening in the noise shaping quantizer 516 as described below.

The LPC coefficients are transformed to a line spectral frequency (LSF) vector. The LSFs are quantized using the first vector quantizer 506, a multi-stage vector quantizer (MSVQ) with 10 stages, producing 10 LSF indices that together represent the quantized LSFs. The quantized LSFs are transformed back to produce the quantized LPC coefficients for use in the noise shaping quantizer 516.

The LPC residual is input to the open loop pitch analysis block 508, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 518 and noise shaping quantizer 516.

For voiced frames, a long-term prediction analysis is performed on the LPC residual. The LPC residual $r_{LPC}$ is supplied from the LPC analysis block 504 to the LTP analysis block 510. For each subframe, the LTP analysis block 510 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - \text{lag} - i)b_i$$

is minimized. The normal equations are solved as:

$$b = W_{LTP}^{-1} C_{LTP},$$

where $W_{LTP}$ is a weighting matrix containing correlation values $$W_{LTP}(i, j) = \sum_{n=0}^{79} r_{LPC}(n + 2 - \text{lag} - i) r_{LPC}(n + 2 - \text{lag} - j),$$

and $C_{LTP}$ is a correlation vector:

$$C_{LTP}(i) = \sum_{n=0}^{79} r_{LPC}(n) r_{LPC}(n + 2 - \text{lag} - i).$$

Thus, the LTP residual is computed as the LPC residual in the current subframe minus a filtered and delayed LPC residual. The LPC residual in the current subframe and the delayed LPC residual are both generated with an LPC analysis filter controlled by the same LPC coefficients. That means that when the LPC coefficients were updated, an LPC residual is computed not only for the current frame but also a new LPC residual is computed for at least lag+2 samples preceding the current frame.

The LTP coefficients for each frame are quantized using a vector quantizer (VQ). The resulting VQ codebook index is input to the arithmetic coder, and the quantized LTP coefficients $b_Q$ are input to the noise shaping quantizer.

The high-pass filtered input is analyzed by the noise shaping analysis block 514 to find filter coefficients and quantization gains used in the noise shaping quantizer. The filter coefficients determine the distribution over the quantization noise over the spectrum, and are chose such that the quantization is least audible. The quantization gains determine the step size of the residual quantizer and as such govern the balance between bitrate and quantization noise level.

All noise shaping parameters are computed and applied per subframe of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder 518. The quantized quantization gains are input to the noise shaping quantizer 516.

Next a set of short-term noise shaping coefficients $a_{shape,\,i}$ are found by applying bandwidth expansion to the coefficients found in the noise shaping LPC analysis. This bandwidth expansion moves the roots of the noise shaping LPC polynomial towards the origin, according to the formula:

$$a_{shape,\,i}=a_{autocorr,\,i}g^{i}$$

where $a_{autocorr,\,i}$ is the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape}=0.5sqrt(\text{PitchCorrelation})[0.25,\,0.5,\,0.25].$$

The short-term and long-term noise shaping coefficients are input to the noise shaping quantizer 516. The high-pass filtered input is also input to the noise shaping quantizer 516.

Figure 6:
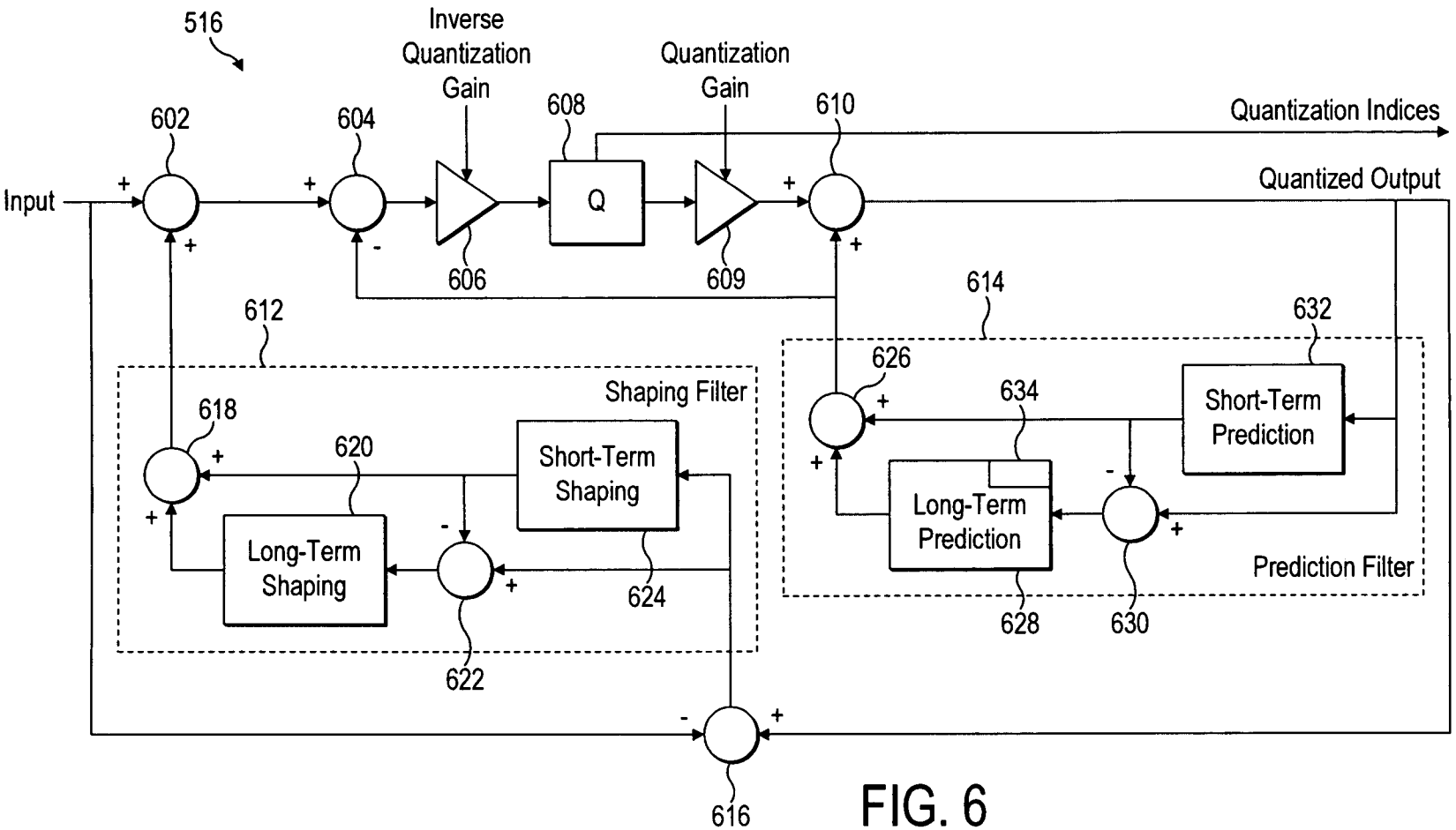
FIG. 6 is a schematic block diagram of a noise shaping quantizer.

An example of the noise shaping quantizer 516 is now discussed in relation to FIG. 6.

The noise shaping quantizer 516 comprises a first addition stage 602, a first subtraction stage 604, a first amplifier 606, a scalar quantizer 608, a second amplifier 609, a second addition stage 610, a shaping filter 612, a prediction filter 614 and a second subtraction stage 616. The shaping filter 612 comprises a third addition stage 618, a long-term shaping block 620, a third subtraction stage 622, and a short-term shaping block 624. The prediction filter 614 comprises a fourth addition stage 626, a long-term prediction block 628, a fourth subtraction stage 630, and a short-term prediction block 632. The long term prediction block 628 comprises an LTP buffer 634.

The first addition stage 602 has an input arranged to receive the high-pass filtered input from the high-pass filter 502, and another input coupled to an output of the third addition stage 618. The first subtraction stage has inputs coupled to outputs of the first addition stage 602 and fourth addition stage 626. The first amplifier has a signal input coupled to an output of the first subtraction stage and an output coupled to an input of the scalar quantizer 608. The first amplifier 606 also has a control input coupled to the output of the noise shaping analysis block 514. The scalar quantiser 608 has outputs coupled to inputs of the second amplifier 609 and the arithmetic encoding block 518. The second amplifier 609 also has a control input coupled to the output of the noise shaping analysis block 514, and an output coupled to the an input of the second addition stage 610. The other input of the second addition stage 610 is coupled to an output of the fourth addition stage 626. An output of the second addition stage is coupled back to the input of the first addition stage 602, and to an input of the short-term prediction block 632 and the fourth subtraction stage 630. An output of the short-term prediction block 632 is coupled to the other input of the fourth subtraction stage 630. The output of the fourth subtraction stage 630 is coupled to the input of the long-term prediction block 628. The fourth addition stage 626 has inputs coupled to outputs of the long-term prediction block. 628 and short-term prediction block 632. The output of the second addition stage 610 is further coupled to an input of the second subtraction stage 616, and the other input of the second subtraction stage 616 is coupled to the input from the high-pass filter 502. An output of the second subtraction stage 616 is coupled to inputs of the short-term shaping block 624 and the third subtraction stage 622. An output of the short-term shaping block 624 is coupled to the other input of the third subtraction stage 622. The output of third subtraction stage 622 is coupled to the input of the long-term shaping block 620. The third addition stage 618 has inputs coupled to outputs of the long-term shaping block 620 and short-term prediction block 624. The short-term and long-term shaping blocks 624 and 620 are each also coupled to the noise shaping analysis block 514, and the long-term shaping block 620 is also coupled to the open-loop pitch analysis block 508 (connections not shown). Further, the short-term prediction block 632 is coupled to the LPC analysis block 504 via the first vector quantizer 506, and the long-term prediction block 628 is coupled to the LTP analysis block 510 via the second vector quantizer 512 (connections also not shown).

The purpose of the noise shaping quantizer 516 is to quantize the LTP residual signal in a manner that weights the distortion noise created by the quantisation into less noticeable parts of the frequency spectrum, e.g. where the human ear is more tolerant to noise, and/or where the speech energy is high so that the relative effect of the noise is less.

In operation, all gains and filter coefficients and gains are updated for every subframe, except for the LPC coefficients, which are updated once per frame. The noise shaping quantizer 516 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 612, described in detail later. The output of the shaping filter 612 is added to the input signal at the first addition stage 602 in order to effect the spectral shaping of the quantization noise. From the resulting signal, the output of the prediction filter 614, described in detail below, is subtracted at the first subtraction stage 604 to create a residual signal. The residual signal is multiplied at the first amplifier 606 by the inverse quantized quantization gain from the noise shaping analysis block 514, and input to the scalar quantizer 608. The quantization indices of the scalar quantizer 608 represent a signal that is input to the arithmetically encoder 518. The scalar quantizer 608 also outputs a quantization signal, which is multiplied at the second amplifier 609 by the quantized quantization gain from the noise shaping analysis block 514 to create an excitation signal. The output of the prediction filter 614 is added at the second addition stage to the excitation signal to form the quantized output signal. The quantized output signal is input to the prediction filter 614.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

The shaping filter 612 inputs the quantization error signal d(n) to a short-term shaping filter 624, which uses the short-term shaping coefficients $a_{shape}(i)$ to create a short-term shaping signal $s_{short}(n)$, according to the formula:

$$s_{short}(n)=\sum_{i=1}^{16}d(n-i)a_{shape}(i).$$

The short-term shaping signal is subtracted at the third addition stage 622 from the quantization error signal to create a shaping residual signal f(n). The shaping residual signal is input to a long-term shaping filter 620 which uses the long-term shaping coefficients $b_{shape}(i)$ to create a long-term shaping signal $s_{long}(n)$, according to the formula:

$$s_{long}(n) = \sum_{i=-2}^{2} f(n - \text{lag} - i) b_{shape}(i).$$

The short-term and long-term shaping signals are added together at the third addition stage 618 to create the shaping filter output signal.

The prediction filter 614 inputs the quantized output signal y(n) to a short-term prediction filter 632, which uses the quantized LPC coefficients $a_Q$ to create a short-term prediction signal $p_{short}(n)$, according to the formula:

$$p_{short}(n) = \sum_{i=1}^{16} y(n - i) a_Q(i).$$

The short-term prediction signal is subtracted at the fourth subtraction stage 630 from the quantized output signal to create an LPC excitation signal $e_{LPC}(n)$.

$$e_{LPC}(n) = y(n) - p_{short}(n) = y(n) - \sum_{i=1}^{16} y(n - i) a_Q(i)$$

The LPC excitation signal is input to a long-term prediction filter 628 which calculates a prediction signal using the filter coefficients that were derived from correlations in the LTP analysis block 51.0 (see FIG. 5). That is, long-term prediction filter 628 uses the quantized long-term prediction coefficients $b_Q(i)$ to create a long-term prediction signal $p_{long}(n)$, according to the formula:

$$p_{long}(n) = \sum_{i=-2}^{2} e_{LPC}(n - \text{lag} - i) b_Q(i).$$

The LPC excitation signal $e_{LPC}(n)$ is stored in an LTP buffer 634 in the long-term prediction 628 block. The LTP buffer 634 is of length at least equal to the maximum pitch lag of 288 plus 2. The signal contained in the LTP buffer 635 is the LTP filter state.

In embodiments of the present invention, the long-term prediction block 628 may modify the LPC excitation $e_{LPC}(n)$ stored in the encoder LTP buffer 634 at the start of every new input frame classified as voiced, when the quantized LPC coefficients $a_Q$ are updated. The modification consists of replacing the LTP filter state with a new LPC excitation signal $e_{LPC,new}$ computed from the quantized output signal y(n) and the new quantized LPC coefficients $a_{Q,new}$:

$$e_{LPC,new}(n) = y(n) - \sum_{i=1}^{16} e_{LTP}(n - i) a_{Q,new}(i).$$

Alternatively or additionally, to deal with the problem of packet loss error propagation, in embodiments of the present invention the scaling control module 520 in the LTP analysis block 520 may scale down the LTP filter state stored in the LTP buffer 634 at the beginning of every new input frame, before the noise shape quantization is started. Sometimes multiple frames are combined within one packet, in which case the LTP scaling should preferably be applied only for the first frame of each packet (whereas the re-whitening is preferably done for every frame). The scaling value is passed from the scaling control module 520 in the LTP analysis block 510 to the long-term prediction block 628 in the noise shaping quantizer 516, where it is used to scale the LTP state stored in the LTP buffer 634.

The LTP scaling value is calculated by a scaling control module 636 based on information about the packet loss in the channel and information about the speech signal. This module 636 chooses between three scaling values of 0.5, 0.7 or 0.95, where 0.5 gives most error propagation resilience and lowest coding efficiency, and 0.95 gives least error propagation resilience and highest coding efficiency.

To assign the scaling value the scaling control module 520 calculates a sensitivity measure that is compared with two thresholds, one for using a scaling value of 0.5 and one for 0.7. Default is using a scaling value of 0.95. The sensitivity measure predicts how sensitive the current frame is to errors in the LTP filter state due to packet losses. It is calculated using the following formula:

$$s = 0.5 \cdot PG_{LTP} + 0.5 \cdot PG_{LTP,HP}$$

Where $PG_{LTP}$ is the long-term prediction gain, as measured as ratio of the energy of LPC residual $r_{LPC}$ and LTP residual $r_{LTP}$, and $PG_{LTP,HP}$ is a signal obtained by running $PG_{LTP}$ through a first order high-pass filter according to:

$$PG_{LTP,HP}(n) = PG_{LTP}(n) - PG_{LTP}(n-1) + 0.5 \cdot PG_{LTP,HP}(n-1)$$

The sensitivity measure is a combination of the LTP prediction gain and a high pass version of the same measure. The LTP prediction gain is chosen because it directly relates the LTP state error with the output signal error. The high pass part is added to put emphasis on signal changes. A changing signal has high risk of giving severe error propagation because the LTP state in encoder and decoder will most likely be very different, after a packet loss. An example is when loosing a voiced onset (see FIG. 4*c*).

The distribution of scaling values for the frames is dependent on the loss percentage where more of the frames get a scaling value less than 0.95 when the channel loss rate increases. This is done by lowering the sensitivity thresholds as the loss rate increases.

If multiple frames are encoded and combined for transmission in one packet, then the state control module 636 only assigns scaling values lower than 0.95 for frames that are the first in a packet.

The scaling value is supplied from the scaling control module 520 in the LTP analysis block 510 to the arithmetic encoder 518, and from there is transmitted on to the decoder in the encoded signal.

The short-term and long-term prediction signals are added together to create the prediction filter output signal.

Note: the LTP state can be either the LPC residual or the LPC excitation signal, depending on details of the encoder. Typically however, as in the described embodiments, it is the LPC excitation signal.

The LSF indices, LTP indices, quantization gains indices, pitch lags, LTP scaling value indices (if used), and quantization indices are each arithmetically encoded and multiplexed at the arithmetic encoder 518 to create the payload bitstream. The arithmetic encoder 518 uses a look-up table with probability values for each index. The look-up tables are created by running a database of speech training signals and measuring frequencies of each of the index values. The frequencies are translated into probabilities through a normalization step.

Figure 7:
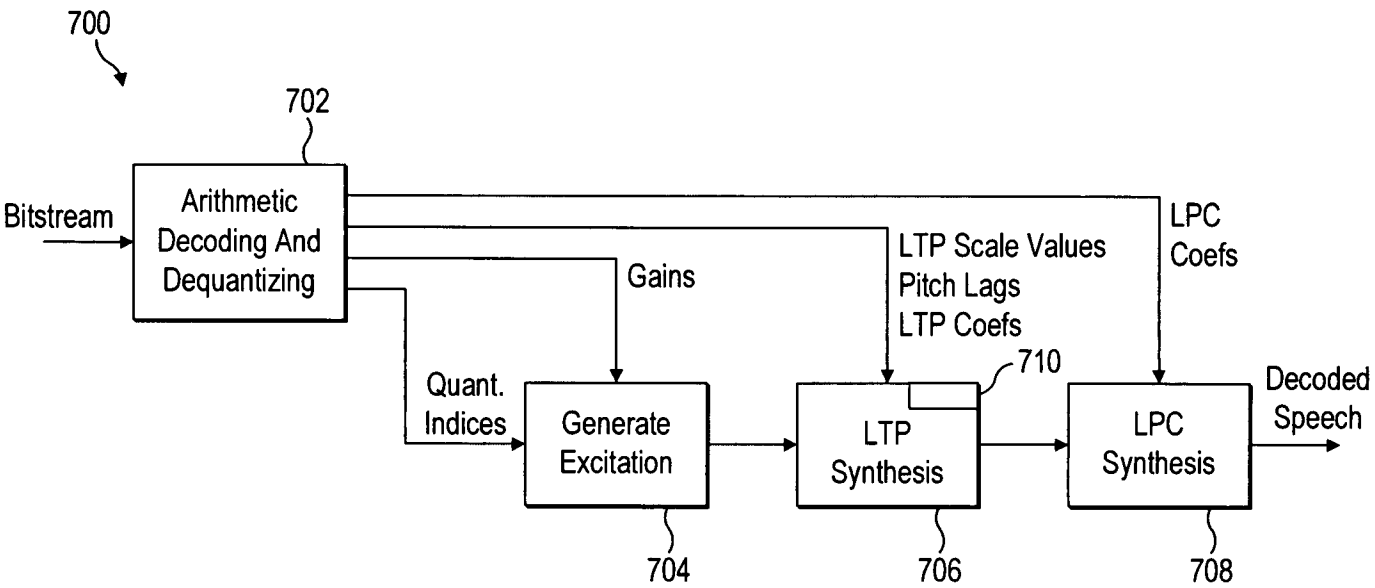
FIG. 7 is another schematic block diagram of a decoder.

An example decoder 700 for use in decoding a signal encoded according to embodiments of the present invention is now described in relation to FIG. 7. The decoder 700 comprises an arithmetic decoding and dequantizing block 702, an excitation generation block 704, an LTP synthesis filter 706, and an LPC synthesis filter 708. The LTP synthesis filter 706 comprises an LTP buffer 710. The arithmetic decoding and dequantizing block 702 has an input arranged to receive an encoded bitstream from an input device such as a wired modem or wireless transceiver, and has outputs coupled to inputs of each of the excitation generation block 704, LTP synthesis filter 706 and LPC synthesis filter 708. The excitation generation block 704 has an output coupled to an input of the LTP synthesis filter 706, and the LTP synthesis block 706 has an output connected to an input of the LPC synthesis filter 708. The LPC synthesis filter has an output arranged to provide a decoded output for supply to an output device such as a speaker or headphones.

At the arithmetic decoding and dequantizing block 702, the arithmetically encoded bitstream is demultiplexed and decoded to create LSF indices, LTP indices, LTP scaling value indices (if used), quantization gains indices, pitch lags and a signal of quantization indices. The LSF indices are converted to quantized LSFs by adding the codebook vectors of the ten stages of the MSVQ. The quantized LSFs are transformed to quantized LPC coefficients. The LTP codebook is then used to convert the LTP indices to quantized LTP coefficients. The gains indices are converted to quantization gains, through look ups in the gain quantization codebook.

At the excitation generation block, the excitation quantization indices signal is multiplied by the quantization gain to create an excitation signal e(n).

The excitation signal is input to the LTP synthesis filter 706 to create the LPC excitation signal $e_{LPC}(n)$ according to:

$$e_{LPC}(n) = e(n) + \sum_{i=-2}^{2} e(n - \text{lag} - i) b_Q(i),$$

using the pitch lag and quantized LTP coefficients $b_Q$.

The excitation signal e(n) is stored in an LTP buffer of length at least equal to the maximum pitch lag of 288, plus 2. The signal contained in the LTP buffer is the LTP filter state.

The LPC excitation signal is input to an LPC synthesis filter to create the decoded speech signal y(n) according to $$y(n) = e_{LPC}(n) + \sum_{i=1}^{16} e_{LPC}(n - i) a_Q(i),$$

using the quantized LPC coefficients $a_Q$.

In embodiments of the present invention, the LTP synthesis filter 706 may modify the LPC excitation $e_{LPC}(n)$ stored in the decoder LTP buffer 710 at the start of every new input frame classified as voiced, when the quantized LPC coefficients $a_Q$ are updated. The modification consists of replacing the LTP filter state with a new LPC excitation signal $e_{LPC,new}$ computed from the decoded speech signal y(n) and the new quantized LPC coefficients $a_{Q,new}$ Alternatively or additionally, if state scaling is used, the LTP synthesis filter 706 may use the decoded LTP scale value to scale down the LTP filter state at the beginning of every new input frame, before LTP synthesis filtering is started. That is, scaling the LPC excitation $e_{LPC}(n)$.

In a particularly advantageous embodiment, if an LTP scale value significantly below one is used, e.g. a value of 0.5 or 0.7, in a frame after one or more packet losses, then the LTP synthesis filter 706 in the decoder 700 may use its knowledge about the LTP scale value to improve the LTP state synchronization further as discussed below.

Figure 8:
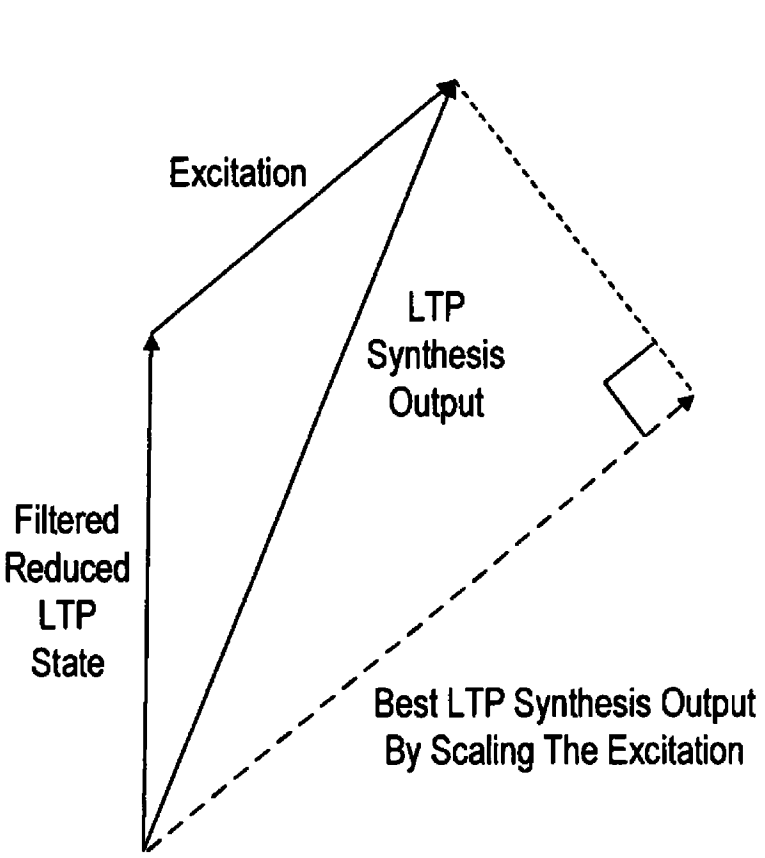
FIG. 8 shows schematically an LTP state and LTP synthesis filter output.
Figure 8:
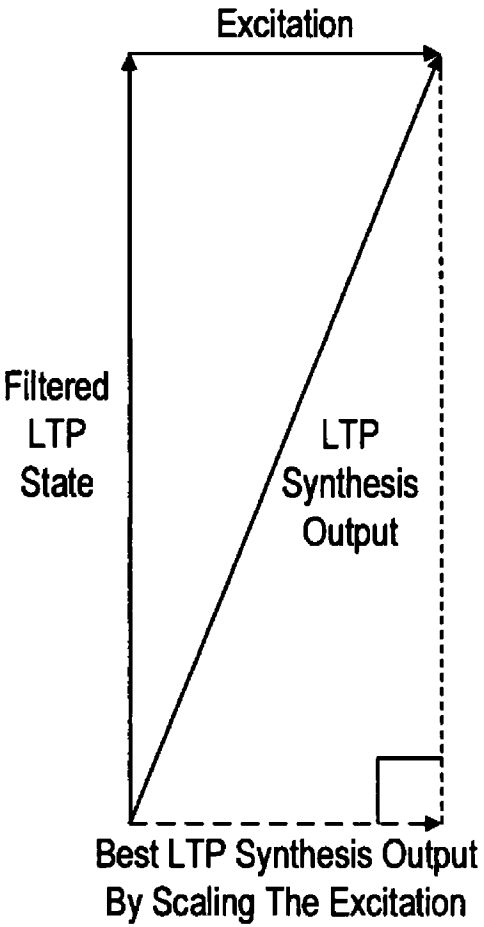

FIG. 8 shows the relationship between the LTP state and LTP synthesis filter output. The LTP synthesis filter delays the LTP state by the pitch lag and convolves it with the LTP filter coefficients to create a filtered LTP state. The filtered LTP state is added to the excitation signal to create the LTP synthesis filter output, or LPC excitation signal.

The left figure shows the filtered LTP state and excitation signal without downscaling, where they are orthogonal. If after a packet loss the LTP state is set to zero, resulting in a zero filtered LTP state, then the excitation signal provides the best approximation to the LTP synthesis output that would have been generated if no packet loss had occurred.

The figure to the right shows the excitation signal with LTP downscaling, using the same optimal LTP coefficients. Here the vectors are not orthogonal anymore, and have positive correlation. The positive correlation between filtered reduced LTP state and excitation can be exploited after a packet loss. If after a loss the LTP state is set to zero, the excitation can be scaled up to give a closer match to the LTP synthesis output that would have been generated if no packet loss had occurred. The optimal scaling is not known on the decoder side, but can be estimated using for instance a trained statistical approach. It was found heuristically that good performance is obtained when upscaling by a factor 1.4 when the LTP scale value is 0.7 and upscaling by a factor 1.8 when the LTP scale value is 0.5.

Figure 9:
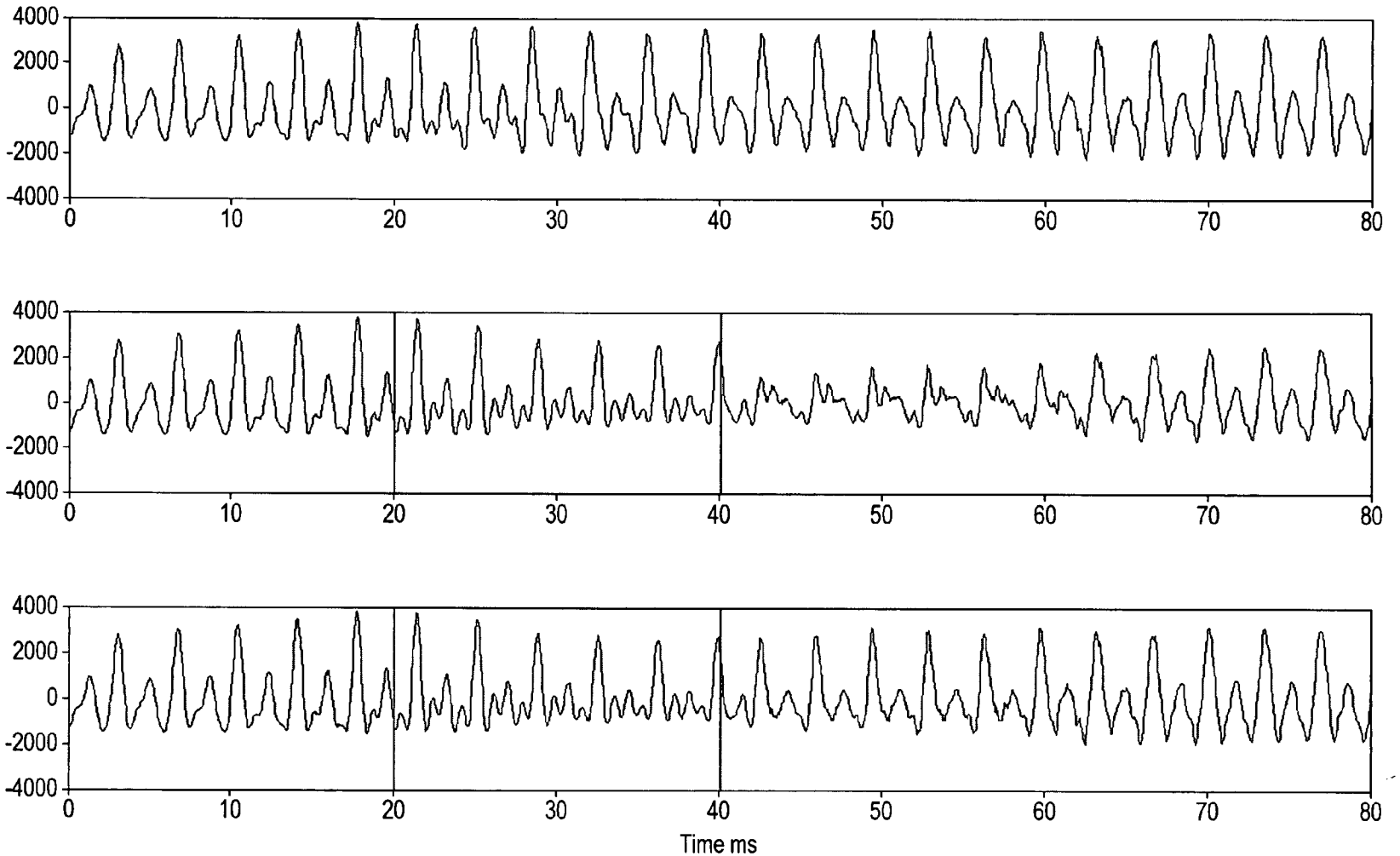
FIG. 9 shows graphs illustrating resynchronisation of the LTP state.

If the LTP state is not set to zero after packet loss, but is approximated using the signal generated with a packet loss concealment unit, another enhancement is used in the decoder. The knowledge of LTP state scaling is exploited by changing the phase of the decoder LTP filter state such as to optimize the correlation with the LTP residual signal for the duration of the first pitch period. This enhancement is useful when the pitch lag used by the concealment unit drifts away from the pitch lag used in the encoder. The advantage is illustrated in the FIG. 9, which is an illustration of the resynchronisation of the LTP state after packet loss. The first plot is a voiced speech signal without packet loss. The second plot illustrates a signal with a lost packet between the vertical lines. LTP state scaling by 0.5 is used, but because the phase of the pitch pulse drifts in the concealment signal compared to the lossless signal the signal after the loss contains a large error in the pitch pulse shape. The last plot shows how synchronising the LTP state such that correlation between filtered LTP state and excitation signal is maximized improves the pitch pulse shape.

Resynchronisation of the LTP state, after packet loss, is a known method in the art of predictive speech coding. However, the technique of LTP state downscaling increases the robustness of the LTP state resynchronisation by giving a good estimate of the pitch pulse phase in the encoder, and therefore a good estimate of the error free signal.

The encoder 500 and decoder 700 are preferably implemented in software, such that each of the components 502 to 634 and 702 to 710 comprise modules of software stored on one or more memory devices and executed on a processor. A preferred application of the present invention is to encode speech for transmission over a packet-based network such as the Internet, preferably using a peer-to-peer (P2P) system implemented over the Internet, for example as part of a live call such as a Voice over IP (VoIP) call. In this case, the encoder 500 and decoder 700 are preferably implemented in client application software executed on end-user terminals of two users communicating over the P2P system.

It will be appreciated that the above embodiments are described only by way of example. Other applications and configurations may be apparent to the person skilled in the art given the disclosure herein. The scope of the invention is not limited by the described embodiments, but only by the appended claims.

According to the invention in certain embodiments there is provided a method of decoding an encoded signal as described above having the following features.

At one or more of said intervals, parameters used to derive the first remaining signal may be updated between determining the respective earlier portion and generating the predicted version of the respective later portion; and said transformation may be performed at said one or more intervals and may comprise updating the stored version of the respective earlier portion of the first residual signal using the updated parameters.

The encoded speech signal may be received as a plurality of packets each encoding a plurality of said intervals, and said transformation of the stored version of the earlier portion may be performed once per packet so as to reduce error propagation caused by potential packet loss in the transmission.

The transformation may comprise scaling down the stored version of the earlier portion by a scaling factor.

According to the invention in certain embodiments there is provided an encoder as described above having the following features.

The first signal processing module may be configured such that, at one or more of said intervals, parameters used to derive the first remaining signal are updated between deriving the respective earlier portion and generating the predicted version of the respective later portion; and the second signal processing module may be configured to perform said transformation at said one or more intervals by updating the stored version of the respective earlier portion of the first residual signal using the updated parameters.

The encoding may be performed over a plurality of frames each comprising a plurality of subframes, where each of said intervals is a subframe;

the second signal processing module may be configured to derive the second remaining signal once per subframe whilst the first signal processing module is configured to update said parameters once per frame, hence at one subframe per frame then the predicted version of the later portion is generated from the earlier portion as derived using a previous frame's parameters but is used to remove said effect of periodicity from the first remaining signal as derived using a current frame's parameters; and the second signal processing module may be configured to perform said transformation of the stored version of the earlier portion at said one subframe per frame by updating the stored version of the respective earlier portion of the first residual signal using the current frame's parameters.

The second signal processing module may comprise at least one of an open-loop pitch analysis block and a long-term prediction analysis block, at least one of which is configured to perform its analysis based on a version of the first remaining signal derived using said updated parameters for both the previous and current frames.

The second signal processing module may be configured to perform said transformation so as to result in a greater reduction in overall energy of the second remaining signal relative to the first remaining signal than without said transformation.

The second signal processing module may be configured to perform said transformation by re-whitening the stored version of the earlier portion.

The output may be arranged to transmit said encoded signal as a plurality of packets each encoding a plurality of said intervals, and the second signal processing module may be configured to perform said transformation of the stored version of the earlier portion once per packet so as to reduce error propagation caused by potential packet loss in the transmission.

The second signal processing module may be configured to perform said transformation for the first interval of each packet.

The second signal processing module may be configured to perform said transformation based on information about the packet loss in a channel used for said transmission.

The second signal processing module may be configured to perform said transformation by scaling down the stored version of the earlier portion by a scaling factor.

The second signal processing means may be configured to select said scaling factor from one of a plurality of specified factors.

The specified factors may have substantially the values of 0.5, 0.7 and 0.95.

The periodicity may correspond to a perceived pitch of the speech signal.

The first signal processing module may comprise a linear predictive coding (LPC) module such that the derivation of said spectral envelope signal is by linear predictive coding and said first remaining signal is an LPC residual signal.

The stored versions of the earlier portions may be stored in the form of a quantized excitation corresponding to respective portions of said LPC residual signal.

The second signal processing module may comprise a long-term prediction (LTP) such that said derivation of the second remaining signal is by long-term prediction and said second remaining signal is an LTP residual signal.

Each of the stored versions of the earlier portions may each comprise an LTP state.

According to the invention in certain embodiments there is provided a decoder as described above having the following features.

The first signal processing module may be configured such that, at one or more of said intervals, parameters used to derive the first remaining signal are updated between determining the respective earlier portion and generating the predicted version of the respective later portion; and the second signal processing module may be configured to perform said transformation at said one or more intervals by updating the stored version of the respective earlier portion of the first residual signal using the updated parameters.

The input may be arranged to receive the encoded speech signal as a plurality of packets each encoding a plurality of said intervals, and the second signal processing module may be configured to perform said transformation of the stored version of the earlier portion once per packet so as to reduce error propagation caused by potential packet loss in the transmission.

The second signal processing module may be configured to perform said transformation by scaling down the stored version of the earlier portion by a scaling factor.

The invention claimed is:

1. A method comprising:

receiving a speech signal;

from the speech signal, deriving a spectral envelope signal representative of a source-filter model and a first remaining signal representative of a modelled source signal, the first remaining signal comprising a plurality of successive portions having a degree of periodicity and being derived using two or more parameters of the source-filter model;

deriving a second remaining signal from the first remaining signal by, at intervals during encoding of said speech signal: exploiting a correlation between ones of said portions to generate a predicted version of a later of said portions from a stored version of an earlier of said portions, and using the predicted version of the later of said portions to remove an effect of said periodicity from the first remaining signal; and transmitting an encoded signal representing said speech signal based on the spectral envelope signal, said correlations, and the second remaining signal;

wherein the method further comprises, at one or more of said intervals, transforming the stored version of the earlier portion of the first remaining signal prior to generating the predicted version of the respective later portion by updating the stored version of the earlier of said portions using updated versions of the two or more parameters of the source-filter model.

2. The method of claim 1, wherein:

wherein the two or more parameters are updated between deriving the respective earlier portion and generating the predicted version of the respective later portion; and said transformation is performed at said one or more intervals.

3. The method of claim 2, wherein:

the encoding is performed over a plurality of frames each comprising a plurality of subframes, and each of said intervals is a subframe;

said deriving of the second remaining signal is performed once per subframe whilst parameters used to derive the first remaining signal are updated once per frame, hence at one subframe per frame then the predicted version of the later portion is generated from the earlier portion as derived using a previous frame's parameters but is used to remove said effect of periodicity from the first remaining signal as derived using a current frame's parameters; and said transformation of the stored version of the earlier portion is performed at said one subframe per frame and comprises updating the stored version of the respective earlier portion of the first remaining signal using the current frame's parameters.

4. The method of claim 3, comprising determining said correlations using at least one of an open-loop pitch analysis and a long-term prediction analysis, at least one of which analyses is based on a version of the first remaining signal derived using said updated parameters for both the previous and current frames.

5. The method of claim 1, wherein said transformation is so as to result in a greater reduction in overall energy of the second remaining signal relative to the first remaining signal than without said transformation.

6. The method of claim 1, wherein said transformation comprises re-whitening the stored version of the earlier portion.

7. The method according to claim 1, wherein the encoded signal is transmitted as a plurality of packets each encoding a plurality of said intervals, and said transformation of the stored version of the earlier portion is performed once per packet so as to reduce error propagation caused by potential packet loss in the transmission.

8. The method of claim 7, wherein said transformation is performed for the first interval of each packet.

9. The method of claim 7, wherein said transformation is based on information about the packet loss in a channel used for said transmission.

10. The method of claim 7, wherein said stored versions of the earlier portions are stored in the form of a quantized excitation corresponding to respective portions of said LPC residual signal.

11. The method of claim 1, wherein said transformation comprises scaling down the stored version of the earlier portion by a scaling factor.

12. A method according to claim 1, wherein the window selection component comprises an interactive actuation element which, when actuated, controls sharing.

13. The method of claim 1, wherein the derivation of said spectral envelope signal is by linear predictive coding (LPC) such that said first remaining signal is an LPC residual signal.

14. The method of claim 1, wherein said derivation of the second remaining signal is by long-term prediction (LTP) such that said second remaining signal is an LTP residual signal.

15. The method of claim 14, wherein each of said stored versions of the earlier portions each comprises an LTP state.

16. A method comprising:

receiving an encoded speech signal;

from the encoded speech signal, determining a spectral envelope signal representative of a modelled filter;

from the encoded speech signal, determining a first remaining signal and a scale value used to encode the encoded speech signal;

deriving a second remaining signal representative of a modelled source signal and comprising a plurality of successive portions having a degree of periodicity, by, at intervals during decoding of said encoded speech signal and utilizing the scale value: determining, from the encoded speech signal, information relating to a correlation between ones of said portions of the second remaining signal, using said information to generate a predicted version of a later of said portions based on a stored version of an earlier of said portions, and reconstructing a corresponding portion of the second remaining signal using the first remaining signal and said predicted version of the later portion; and generating a decoded speech signal based on the second remaining signal and the spectral envelope signal, and outputting the decoded speech signal to an output device.

17. An encoder comprising:

an input arranged to receive a speech signal;

a first signal processing module configured to derive, from the speech signal, a spectral envelope signal representative of a modelled filter and a first remaining signal representative of a modelled source signal, the first remaining signal comprising a plurality of successive portions having a degree of periodicity;

a second signal processing module configured to derive a second remaining signal from the first remaining signal by, at intervals during the encoding of said speech signal: exploiting a correlation between ones of said portions to generate a predicted version of a later of said portions from a stored version of an earlier of said portions, and using the predicted version of the later portion to remove an effect of said periodicity from the first remaining signal; and an output arranged to transmit an encoded signal representing said speech signal based on the spectral envelope signal, said correlations, and the second remaining signal;

wherein the first signal processing module is configured to update parameters used to derive the first remaining signal subsequent to deriving the earlier of said portions, and the second signal processing module is further configured to transform, at one or more of said intervals, the stored version of the earlier portion of the first remaining signal prior to generating the predicted version of the respective later portion by updating the stored version of the earlier of said portions using the updated parameters.

18. A decoder comprising:

an input arranged to receive an encoded speech signal;

a first signal processing module configured to determine, from the encoded speech signal, a spectral envelope signal representative of a modelled filter; and a second signal processing module configured to determine, from the encoded speech signal, a first remaining signal and a scale value used to encode the encoded speech signal;

wherein the second signal processing module is further configured to derive a second remaining signal representative of a modelled source signal and comprising a plurality of successive portions having a degree of periodicity, by, at intervals during the decoding of said encoded speech signal and utilizing the scale value: determining, from the encoded speech signal, information relating to a correlation between ones of said portions of the second remaining signal, using said information to generate a predicted version of a later of said portions based on a stored version of an earlier of said portions, and reconstructing a corresponding portion of the second remaining signal using the first remaining signal and said predicted version of the later portion; and the decoder further comprises an output module configured to generate a decoded speech signal based on the second remaining signal and the spectral envelope signal, and output the decoded speech signal to an output device.

19. A computer program product for encoding speech, the program product comprising code arranged so as when executed on a processor to:

receive a speech signal;

from the speech signal, derive a spectral envelope signal representative of a modelled filter and a first remaining signal representative of the modelled source signal, the first remaining signal comprising a plurality of successive portions having a degree of periodicity and being derived using parameters of the modelled filter;

derive a second remaining signal from the first remaining signal by, at intervals during encoding of said speech signal: exploiting a correlation between ones of said portions to generate a predicted version of a later of said portions from a stored version of an earlier of said portions, and using the predicted version of the later portion to remove an effect of said periodicity from the first remaining signal;

transmit an encoded signal representing said speech signal based on the spectral envelope signal, said correlations and the second remaining signal; and at one or more of said intervals, transform the stored version of the earlier portion of the first remaining signal prior to generating the predicted version of the respective later portion by updating the stored version of the earlier of said portions using updated versions of the parameters of the modelled filter.

20. A computer program product comprising code arranged so as when executed on a processor to:

receive an encoded speech signal over a communication medium;

from the encoded speech signal, determine a spectral envelope signal representative of a modelled filter;

from the encoded speech signal, determine a first remaining signal and a scale value used to encode the encoded speech signal;

derive a second remaining signal representative of a modelled source signal and comprising a plurality of successive portions having a degree of periodicity, by, at intervals during decoding of said encoded speech signal and utilizing the scale value: determining, from the encoded speech signal, information relating to a correlation between ones of said portions of the second remaining signal, using said information to generate a predicted version of a later of said portions based on a stored version of an earlier of said portions, and reconstructing a corresponding portion of the second remaining signal using the first remaining signal and said predicted version of the later portion; and generate a decoded speech signal based on the second remaining signal and spectral envelope signal, and output the decoded speech signal to an output device.

* * * * *